US009709001B2

(12) United States Patent
Buck

(10) Patent No.: US 9,709,001 B2
(45) Date of Patent: Jul. 18, 2017

(54) INTERNAL COMBUSTION ENGINE WITH HINGED ACCESS TO LOWER BLOCK

(71) Applicant: Kenneth Michael Buck, Winterville, NC (US)

(72) Inventor: Kenneth Michael Buck, Winterville, NC (US)

(73) Assignee: GLOBAL IP DEVELOPMENT FOUNDATION, Panama (PA)

( * ) Notice: Subject to any disclaimer, the term of this patent is extended or adjusted under 35 U.S.C. 154(b) by 956 days.

(21) Appl. No.: 14/036,979

(22) Filed: Sep. 25, 2013

(65) Prior Publication Data

US 2014/0090620 A1 Apr. 3, 2014

Related U.S. Application Data

(60) Provisional application No. 61/706,832, filed on Sep. 28, 2012.

(51) Int. Cl.
*F02F 1/42* (2006.01)
*F02F 7/00* (2006.01)

(52) U.S. Cl.
CPC ..... *F02F 7/0021* (2013.01); *F02F 7/0031* (2013.01)

(58) Field of Classification Search
CPC ..... F02F 7/0021; F02F 7/0031; F02F 7/0024; F02F 7/0046; F02F 7/0082; F02F 7/0095; F02F 2007/0097; F02F 2200/00; F02F 2200/06
See application file for complete search history.

(56) References Cited

U.S. PATENT DOCUMENTS

| | | | | |
|---|---|---|---|---|
| 898,678 | A | 9/1908 | Piggins | |
| 900,083 | A | 10/1908 | Clark | |
| 904,562 | A | 11/1908 | Rathbun | |
| 1,145,995 | A | 7/1915 | Johnson | |
| 1,260,847 | A | 3/1918 | Winton | |
| 1,408,179 | A | 2/1922 | Du Pont | |
| 1,622,965 | A | 3/1927 | Napier et al. | |
| 2,491,630 | A | 12/1949 | Voorhies | |
| 4,135,478 | A * | 1/1979 | Rassey | F01B 1/12 123/195 AC |
| 4,763,619 | A | 8/1988 | Eitel | |
| 6,196,181 | B1 | 3/2001 | Pong | |
| 6,543,405 | B2 | 4/2003 | Sachdev et al. | |
| 7,146,724 | B2 | 12/2006 | Millerman | |
| 2006/0096568 | A1 * | 5/2006 | Buck | F02F 7/0031 123/197.4 |

* cited by examiner

*Primary Examiner* — Hung Q Nguyen
(74) *Attorney, Agent, or Firm* — Flynn IP Law

(57) ABSTRACT

Hinge pins for use in a method of accessing a crankshaft within an internal combustion engine that includes: A) inserting a first hinge pivot of a first hinge pin into a first bore on a front side of the internal combustion engine and locking in place; B) inserting a second hinge pivot of a second hinge pin into a second bore on a rear side opposite from the front side of the internal combustion engine and locking in place; and C) rotating the upper block upward around an axis of rotation running through the first bore and the second bore to expose a cavity between the upper block and the lower block to allow access to the crankshaft.

18 Claims, 26 Drawing Sheets

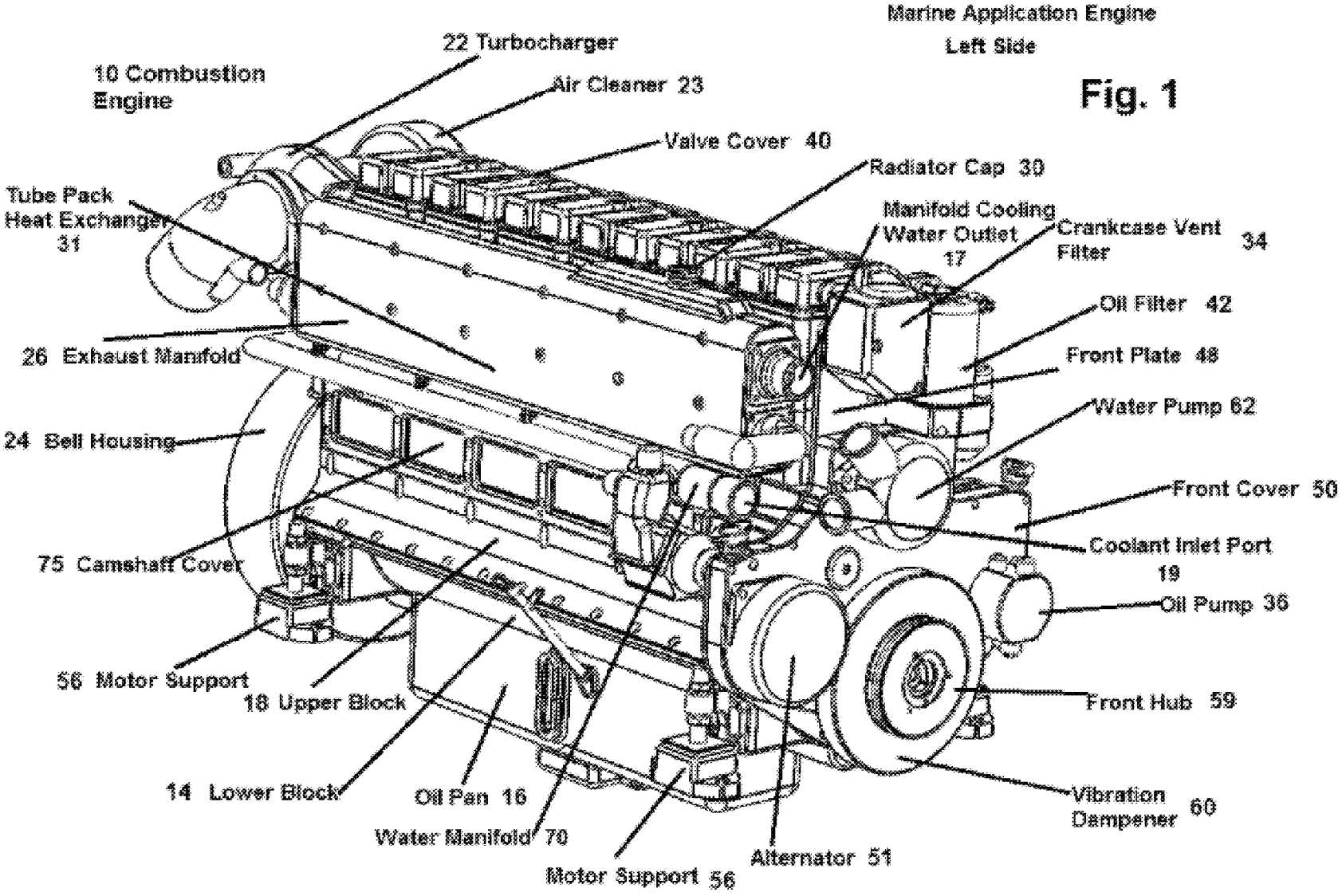
Marine Application Engine
Left Side
Fig. 1
10 Combustion Engine
22 Turbocharger
Air Cleaner 23
Valve Cover 40
Radiator Cap 30
Manifold Cooling Water Outlet 17
Crankcase Vent Filter 34
Oil Filter 42
Front Plate 48
Water Pump 62
Front Cover 50
Coolant Inlet Port 19
Oil Pump 36
Front Hub 59
Vibration Dampener 60
Alternator 51
Motor Support 56
Water Manifold 70
Oil Pan 16
14 Lower Block
18 Upper Block
56 Motor Support
75 Camshaft Cover
24 Bell Housing
26 Exhaust Manifold
Tube Pack Heat Exchanger 31

132

INTERNAL COMBUSTION ENGINE WITH HINGED ACCESS TO LOWER BLOCK

CROSS-REFERENCE TO RELATED APPLICATIONS

This application claims the benefit of priority of U.S. Provisional Patent application 61/706,832, which is incorporated herein in its entirety.

BACKGROUND

This invention relates generally to the field of internal combustion engines and more specifically to an internal combustion engine of modular construction with a tilt top access and process for making same.

The internal combustion engine has been offered in many shapes and forms for over a hundred years. Design and construction of these engines has for the most part been limited to large heavy bulky castings that offer few weight saving advantages and even fewer options for ease of service or repair. In the prior art, the crankcase and cylinders are all cast in one unit and the cylinder head is normally cast in one unit as well. These engines are utilized in all types of land, sea and aviation applications. An important consideration in each of these applications is the size and weight of the engine. There is normally a trade-off between the structural integrity or durability of an engine and the size and weight of the engine. Engine manufacturers design overly massive engine parts to increase the durability and useful life of an engine. However, utilization of massive engine parts increases the weight and size of the engine and can actually increase engine wear by increasing the dynamic weight of the moving parts. Thus there is a need for an engine that is lighter in weight, more compact in design and also durable. Further, because the prior art uses engine blocks that are cast as single units, the blocks are cast with a single continuous water jacket. The coolant enters the front of the engine and travels through the connected cylinder water jackets in a direction that is parallel to the crankshaft and increasing in temperature as the coolant passes from cylinder to cylinder. The coolant then returns to the front of the engine by way of a single cast cylinder head, again traveling parallel to the crankshaft and further increasing in temperature. This prior art creates a long cooling path that in turn creates hot spots in the engine with the last cylinders to receive coolant operating at higher temperatures than the first cylinders. When cast in one unit, consisting of crankcase, cylinders and water jackets, if there are defects in the casting, the entire casting needs replacement. Replacement of large and heavy castings is very time consuming and costly. When large castings with intricate cores are produced, the possibility of failure is increased. Casting failures drive manufacturing cost up and this translates to higher consumer cost. In the large single casting, heat is transferred from one cylinder to another through thermal conductivity and this leads to additional engine cooling issues. The prior art, with its large and heavy castings, also means higher shipping weights and larger inventory requirements, adding once again to the delivered cost of the final product.

U.S. Pat. No. 6,196,181, which issued to Pong on Mar. 6, 2001, describes an engine which employs a cam follower mechanism to reduce wear and reduce the size of an assembled engine. The cam follower mechanism utilizes guide rails located to reduce side thrust on the valve stem. The engine employs a high speed quill shaft to synchronize independent cam shafts existing in each of a plurality of interconnected engines. The engine is assembled using a single size fastener to provide a uniform stress gradient within the engine. The engines are interconnected utilizing O-ring seals. The engine provides a piston crown utilizing a connecting rod directly connected to the bottom surface of the piston crown. The piston crown is stabilized along the longitudinal cylinder axis by a rail guide. Connecting rods are provided which require less than one hundred eighty degrees (180 degree) circumference of a crankshaft pin for support so that a plurality of connecting rods can be associated with a single crankshaft pin. A tabbed bearing fits under the plurality of connecting rods to provide lubrication between the connecting rods and the crankshaft pin. Connecting rods are held to the crankshaft pin by a circular retaining ring. The engine provides a separate cylinder head and cylinder which is attached via a circular deformable retaining band to form a metal to metal seal. The engine provides an independent lubrication system in each engine. Coolant or lubricant is provided to each engine in parallel so that the temperature of the coolant entering each engine is the same. A large diameter modular crankshaft is provided. The engine is assembled by interconnecting two engine halves around the cylinder barrel to form one engine unit.

U.S. Pat. No. 4,763,619, which issued to Eitel on Aug. 6, 1988, describes a multi-cylinder internal combustion engine of the type having a crankshaft and a block comprised of first and second mating half sections joined in a common plane which passes through and along the axis of the crankshaft. The half sections provide a crankcase crankshaft bearing support and cylinder portions. A unitized cylinder head and sleeve construction is provided. A cooperative securing mechanism is provided for securing the unitized cylinder head and sleeve construction to the engine block. The invention relates to a multi-cylinder internal combustion engine utilizing a split block and crankcase with a unitized cylinder head and liner, and more particularly to such an internal combustion engine utilizing multiple cylinders in which the block is formed in two half sections joined in a common plane which passes through and along the axis of the crankshaft and in which the two half sections comprise a unitized cylinder head and liner.

U.S. Pat. No. 2,491,630, which issued to Voorhies on Dec. 20, 1949, describes an internal combustion engine with a vertically split cylinder construction wherein the entire head, block, and crankcase are formed in two half sections and bolted together.

U.S. Pat. No. 1,408,179, which issued to Paul du Pont on Feb. 28, 1922, describes an internal combustion engine with a casing or housing of a special form and construction which forms a complete enclosure for the engine and by removal of a unitary cover permits convenient access to all the internal parts of the engine.

U.S. Pat. No. 1,622,965, which issued to Napier on Mar. 29, 1927, describes an internal combustion engine with each cylinder comprising a head and a barrel formed as a unit by forging of the head with the barrel.

U.S. Pat. Nos. 1,260,847; 1,145,995 and 900,083, describe an internal combustion engine with separate cylinder heads and barrels, but in that prior art the focus is on the improvement of the water jacket cooling system surrounding the cylinders and improvements thereto.

U.S. Pat. Nos. 904,562; 898,678, describe an internal combustion engine with separate cylinder heads and barrels, but in that prior art the focus is on the reduction of the number of pipes and fittings necessary to cause the cylinder water jacket cooling system to work.

U.S. Pat. Nos. 6,543,405 and 7,146,724 B2 Millerman, describes an internal combustion engine with a method of assembly using a lower block arrangement and a one piece extruded cylinder module comprising all cylinders as a Siamese unit. With this invention, the connecting rods must be installed on the crankshaft before the crankshaft can be installed in the engine. This approach is very difficult and awkward for a single technician to perform, especially during a field repair. The patent also refers to a mid-plate that is passed over all the pistons at the same time. This task is also very difficult for one technician to perform. When the one piece extruded multi-cylinder unit is installed over the pistons, inserting the pistons into the cylinders without damage to the piston rings presents a challenge. This will require several technicians working together or will require very special tools or fixtures as described in the patent. Field repair will be extremely difficult and will certainly result in many engine failures due to poor repairs. The Millerman patent refers to the use of a V style upper cylinder assembly and states that such a V style assembly can be installed on the same lower block design. However, the use of a V style upper assembly is not possible using Millerman's design. In the V application the rotating assembly would strike the sides of the lower block and therefore cannot work. Millerman's design also makes no provision for the replacement of the main journal housings and, if damaged, the entire engine along with the lower block would need to be removed and transported for repair. This repair would require line boring which is a very special machining process and line boring is also required during the original production process.

Almost all the prior art has approached the construction of an internal combustion engine not as a set of small light components, but more as a whole engine with large heavy component parts. As a result, there are numerous deficiencies in the prior art that the present invention overcomes. This unique invention presents an upper and lower block construction with modular cylinders as well as a tilting upper block design in which the major engine parts are interchangeable. Specifically, the lower block of the engine forms the base on which all other parts mount and is capable of receiving either in-line or V style upper block units. The lower block is essentially the same design for all engines within the engine family, only varying in length to accommodate more or less cylinders, as required by the application. Mounted on the upper block is a plurality of single separate modular cylinder jug(s). Each cylinder jug, regardless of the number of cylinders needed for the size engine application, is cast and machined to the same dimensions for the engine family. Mounted on and through the modular cylinder jug is a single separate modular cylinder head. Each head, regardless of the number of cylinders needed for the size engine application, is cast and machined to the same dimensions for the engine family. Mounted on the cylinder head is a single separate modular cylinder head valve cover. Each head valve cover, regardless of the number of cylinders needed for the size engine application, is cast and machined to the same dimensions for the engine family. Within each cylinder jug is located a cylinder sleeve all of which are dimensionally the same for the engine family. The prior art teaches that an engine is cast as two large major parts, a Siamese cylinder block and a single cylinder head covering a complete bank of cylinders. The block and the head are both single large and heavy castings for the number of cylinders required in the application. The numerous deficiencies in the prior art will be enumerated now and the invention's qualities and benefits, that overcome these deficiencies, will be detailed.

In the prior art, if parts of the engine such as the pistons, piston rings, valves, cylinder sleeves, cylinder heads, crankshafts or other parts internal to the engine need repair, due to the large single castings, the entire engine needs to be removed and disassembled for repairs. This is expensive and time consuming. In the present invention, the design construction allows quick and economical repairs to individual cylinders and the entire engine does not need to be disassembled. In order to work on any individual cylinder jug, piston, rings, head or connecting rod, only the cylinder module that needs repair is affected. In the case of the crankshaft, the main bearings can be replaced from the top of the engine and if damaged, the main journal housings are also replaceable. Both bearings and bearing housings can be replaced without the removal of the lower block casting from the application. No repair machining of major castings is ever required and this includes line boring. This saves repair time and cost.

With the prior art, the single Siamese block and head castings are large and heavy. This results in added weight which the engine work is required to overcome. In applications where the engine is used to propel a vehicle, marine vessel or airplane, this results in added cost of operation including greater fuel usage. The present invention using small, modular parts and its ability to use lighter metals, reduces the weight of the engine by as much as one half and thereby reduces the cost of operation. The reduced weight is accomplished by virtue of the fact that lighter metals such as aluminum can be used while still maintaining durability. With the crankshaft cradled into the lower block, the downward force of the combustion event sends this force into the major lower block casting and not onto the caps or cap threads as with the prior art. With the present invention the upper and lower blocks can be die cast without the need for intricate and fragile cores. With the present invention, there are no cast-in water or oil galley channels in either the lower or upper block. This reduces the casting cost as well as the number of casting defects thereby reducing the overall production cost. Less metal waste in manufacture of the engine parts results in engine production savings over the prior art. Further, because in the prior art blocks and heads are large and single cast, there is a requirement for larger manufacturing and machining equipment in order to produce the parts. These larger machines are more expensive and occupy more space on the manufacturing floor. The present invention utilizes smaller manufacturing and machining equipment which is less expensive and takes up less manufacturing floor space. Further, in the prior art, if there is a defect in the manufactured casting of the large block or head or if there is a later failure in the casting, the entire large and heavy casting will need to be scraped and replaced. In the present invention, only the failed modular part, modular cylinder jug, or modular cylinder head, will need to be replaced, with no affect on the other cylinders. By removing the water jackets from the large Siamese engine block casting and incorporating them into the small individual cylinder jugs and cylinder heads, the process is simplified tremendously. With the present invention, casting failures will be rare. An additional benefit is that with no cores required in the upper and lower block casting production, there will be no need to remove or wash out casting cores, which can be a difficult and time consuming process. The elimination of this core removal process will reduce the cost of producing these parts. Another tremendous benefit of this new invention is that when the individual cylinders and heads are replaced, the water jackets are also replaced. The present invention provides little concern for water jacket failure. Thermal cavitation and galvanic corrosion as well as other factors cause many premature water jacket failures but, with the present invention, concern for water jacket failure is virtually eliminated. Due to the difficulty and cost of repair, the prior art uses thick and heavy water jacket walls in order to overcome the problem of premature water jacket failures and to increase the longevity of the castings. This only adds to the engine weight. With the present invention, the ease and inexpensiveness of water jacket replacement, allows the use of thinner and lighter water jacket materials. All of the shortcomings of the prior art ultimately affects the consumer price in a negative way.

In the prior art, engines are cooled by a water jacket cast in the Siamese cylinder block and cylinder head. The coolant path is a single loop of front to back and back to front coolant flow. It enters the engine block at one point in the front and travels through the engine to the rear where it returns to the front of the engine via the one piece cylinder head. As the coolant travels from front to back, it travels in a path that is parallel to the crankshaft and it increases in temperature as it passes each cylinder, resulting in the cylinders last to receive coolant operating at higher temperatures. The coolant returns to the front of the engine through the cylinder head and also travels in a path that is parallel to the crankshaft. Once again the coolant increases in temperature as the coolant passes each cylinder in line. This results in operating inefficiency and in accelerated engine wear in the hotter cylinders. In the present invention, the chilled coolant is delivered to each cylinder individually via a common water manifold. The coolant is delivered to the bottom of each separate individual cylinder jug and enters into the cylinder jug water jacket surrounding the cylinder sleeve. The coolant travels through the cylinder jug in a path that is perpendicular to the crankshaft. After circulating around the individual cylinder jug and sleeve, the coolant exits the cylinder jug into the individual cylinder head where the coolant travels in a perpendicular path to the cylinder jug coolant flow and perpendicular to the crankshaft. After cooling and crossing through the cylinder head, the coolant exits into the wet exhaust manifold. The coolant then returns to the heat exchange device to be cooled for recirculation. In the present invention application, each individual cylinder is supplied with coolant that is uniformly cold in temperature and the coolant path through each cylinder is the same length, thereby creating a more effective and uniform cooling process. Cooling paths through the individual cylinders is only a matter of a few inches and not a matter of feet, as is with the prior art. The cooling paths are parallel to each other yet perpendicular to the crankshaft. Shorter cooling paths means a greater volume of cold coolant comes in contact with each cylinder. There is no through engine coolant warm up (coolant temperature stacking), causing some cylinders to operate hotter than the other cylinders. Unlike the prior art, the inventive engine operates more efficiently and with less wear, thereby reducing the need for repairs and reducing operating cost when compared to the prior art. Further, in the present invention, additional cooling is provided by an air gap between each individual cylinder jug and head assembly unit and the next in-line cylinder jug and head assembly unit, mounted on a multi-cylinder engine. The air gap allows air to circulate around the individual cylinder units to provide additional cooling. Further, since the units are not attached metal to metal, as is the case in the Siamese cylinder cast cylinder block of the prior art, there is no thermal heat transfer from one cylinder to the next. The prior art creates excessive thermal conductivity throughout the entire Siamese single cast cylinder block and cylinder head. With the new art, the use of lighter metals such as aluminum for cylinder jugs and cylinder heads, is possible. The lower block can also be cast in aluminum or other lightweight metals since the crankshaft is cradled in the lower block and not suspended on caps and cap threads. The upper block can also be cast in light metals since the underside is easily accessible for machining and all critical threads can be steel lined easily with reverse mounted inserts. Aluminum can be used in areas such as water jackets that will allow for faster heat transfer and therefore provide improved cooling. In the prior art, the horizontal and parallel flow of the coolant through the water jackets can be restricted by casting requirements such as push rod passages and other obstructions that reduce the efficiency of the coolant flow. In the present invention the perpendicular to the crankshaft flow of the coolant through the cylinder jug(s) eliminates obstruction concerns. The current invention also provides for a coolant flow through the cylinder head that is perpendicular to the coolant flow in the cylinder jug(s) and also perpendicular to the crankshaft.

This current invention allows the use of a conventional camshaft (driven by steel gears) and flat tappet or roller lifters. It uses a standard pushrod design, the durability of which has been proven for more than one hundred years. In the prior art, due to the lack of interchangeability of parts, dealers and parts suppliers are required to maintain large parts inventories in order to supply the needs of their customers. In the present invention, the interchangeability of the parts within a large engine family is over ninety percent so parts inventories can be reduced considerably. With the present invention, large parts inventories are no longer required due to front and rear part interchangeability as well as cylinder modules and head modules being interchangeable within the engine family. This reduces inventory carrying cost as well as repair costs. With the present invention an engine family can be created that all use the same displacement per cylinder. A 2, 3, 4, 5, 6, 8 and 10 cylinder in-line engine family can be constructed that all use the same parts. The family can be extended to include a V 4, 6, 8, 10, 12, 16 and 20 cylinder engines that use the same parts as well. The lower block for the in-line 6 is the same lower block for the V 12. The in-line engine front and rear assemblies are all the same and are interchangeable and the V front and rear assemblies interchange with all V engines within the engine family. Finally, in the present invention a single individual cylinder module can be easily replaced without disassembly of other parts of the engine. Using a tapered mating design where the cylinder head mates with the intake and exhaust manifold, the removal and replacement of a single cylinder module, consisting of a valve cover, cylinder head, cylinder jug, piston, connecting rod and rod bearing, is easily accomplished from the top of the engine, without the removal or loosening of other parts. The connecting rod bolts are installed and removed from the top of the engine and their splayed insertion application eliminates tool interference. The process of removing and replacing a single complete cylinder can be easily accomplished by a single technician within a few minutes.

SUMMARY

The primary object of this inventive engine building design and process is to simplify the manufacturing of the inventive engines as well as reduce the weight of the individual parts, thereby offering a lighter yet durable engine. In addition, this new invention will offer an engine that is more efficient as well as more environmentally friendly. Ease of repair is a primary focus of the design, and tremendous interchangeability of parts will result in smaller dealer inventories. This engine manufacturing process can be adapted to all forms of engine building from in-line to V styles and is scalable from small compact cars to large ships. There are many added benefits of this engine building process including significantly improved cooling, improved lubrication, easier access to critical power train parts such as pistons, wristpins, rings, liners, connecting rods and crankshafts as well as a tremendous reduction in repair time and cost.

Conventional engine construction creates engine block castings that contain internal water jackets for cooling the combustion cylinders and, over time, these water jackets become damaged through various corrosion processes. When the water jackets fail, the entire engine block needs to be replaced. This new engine building process creates individual water jackets around each engine cylinder and these individual water jackets can be replaced without affecting other parts of the engine. With this process, the entire upper portion of the engine including cylinder jugs (with water jackets), cylinder heads, pistons, rings, wristpins, connecting rods and rod bearings can be replaced without removing the oil pan or even draining the oil. The crankshaft main bearings can also be replaced without removing an oil pan or draining the engine oil. This process allows for small individual cylinder jugs and cylinder heads that are light and easy for one service technician to handle as well as less expensive to replace when damaged. The lower block and upper block design makes accessing all parts of the engine easier for a single technician. No hoist or cranes are required even with large engine applications. This modular engine design is tremendously beneficial to the cooling processes of the internal combustion engine. The process allows the coolant to be supplied to each cylinder independent of the other cylinders and therefore allows all cylinders to be cooled evenly. This process also shortens the cooling path that the engine coolant must flow, allowing it to return to the heat exchanger device more quickly and thereby providing a greater volume of cold coolant to the cylinders. The coolant travels in a path through the cylinder jug that is perpendicular to the crankshaft with fewer obstructions and through the cylinder head at a right angle to the cylinder jug coolant flow and also perpendicular to the crankshaft. Through better cooling, the use of higher combustion temperatures and higher compression ratios are possible. Higher compression ratios equate to better fuel combustion, efficiency and economy. This process will also lower engine emissions by allowing for higher engine intake air boosting, higher compression ratios and a greater range of the fuel timing. There have been other modular processes offered in the past, but most create more complexity and add greater difficulty during repair. With this new engine building process, an entire family of engines can be created that offer identical front and rear components while maintaining identical intermediate parts.

This new engine building process is accomplished by the construction of a lower engine block upon which all other engine parts are mounted. All parts are installed from the top of the engine for easier and faster service. This process allows the use of a single camshaft located within the upper block that can be removed from the front, back or side of the engine. The engine crankshaft is cradled in the lower block with all the downward force being applied to the lower primary casting and not onto caps or cap bolt threads. The lower and upper block contain no cast in coolant or oil passages and require a very simple die casting process to produce. The benefits of this new inventive engine are many and most of the benefits will benefit the end user.

Internal combustion engines, particularly reciprocating internal combustion engines, are precision machines which convert chemical energy, contained in various fuels, to kinetic energy at the crankshaft. Multi-cylinder internal combustion engines achieve this energy conversion as a result of the interplay of many parts produced by a number of processes such as casting, machining, extruding, welding, grinding, and other processes. Most of these processes are practiced best in the controlled confines of dedicated production facilities such as machining centers, precision foundries, extrusion mills, and other facilities. Engines are subjected to an almost limitless number of applications in terms of the types of equipment and vehicles that require engine power. There is almost a limitless number of marine, land and aviation based applications. Because vehicles and items of equipment such as welders, compressors, generators, and boats are operated in very aggressive environments, often at locations far from established repair facilities, it is desirable to provide for field repair-ability by less than expert individuals. Unfortunately, with most known engine designs, repair-ability is scarcely more than an afterthought. For example, repairs to the main bearings of engines used in watercraft frequently require that engine oil pans be removed and engines be jacked up so that the main bearing caps can be accessed. In cases where an engine main journal is damaged, the entire engine must be removed. When engine removal is required, hulls or decks of the watercraft must be opened up to permit removal of the engine as a unit. If this opening and closing cost is born by the engine manufacturer, the warranty cost soars. Moreover, removal of the engine as a unit is generally required if anything is amiss with the Siamese cylinder block. These repairs are difficult and very costly and usually cannot be performed by indigenous personnel, if for no other reason than the inability to replicate the engine builder's original tolerances and engine manufacturing processes. Engines incorporating the present inventions are ideally suited to operation in tough environments because their construction details inherently lead to much greater repair-ability. The ability to replace worn or damaged internal parts without machining, without cranes or hoist, without damage to the surrounding parts of the application and without the necessity of affecting undamaged assemblies, provides a tremendous advantage to the user. Furthermore, all of the parts of the inventive engine can be replaced from the top of the engine, eliminating the need to remove the oil pan or jack up the engine. Replaceable main journal housings eliminate the need for line boring due to a damaged journal. Moreover, the inventive engines have features which reduce manufacturing complexity and prolong the useful life of the engines themselves. The present inventions may be employed with engines utilizing not only diesel combustion systems, but also spark ignition systems. The inventive engines can also operate on liquid or gaseous fuels. In either case, any of these engines may be naturally aspirated, turbocharged, or supercharged. The present invention allows an engine to be completely repaired and serviced in place, without removal from the application, whether the engine is located below decks in a boat, on an oil rig platform, used in a combat zone or a piece of machinery on a job site.

Whether it is a two, three, four, five, six, eight or ten cylinder lower block configuration, in-line or V style upper blocks allow for a wide range of engine displacements. This new engine invention allows the use of lighter materials for both upper and lower blocks as well as cylinder jugs and cylinder heads. The multiple component approach allows for lighter parts that are easier to handle, less expensive to ship and less expensive to produce. With the crankshaft installed from the top and with it being cradled in the lower block, there is no concern for "Knocking the Bottom Out" of the engine. "Knocking the Bottom Out" is a term that knowledgeable people use for the failure of main bearing caps or the stripping of main journal cap bolt threads due to excessive combustion pressures. Greater power density is possible with this invention since the downward forces on the crankshaft are transmitted into a large primary casting that supports the crankshaft. The ability to replace the main bearings of the engine from the top without the removal of the oil pan or jacking up of the engine is also a tremendous benefit. With the ability to remove and replace the main journal housings, even a spun main bearing can be repaired in the field without a need for line boring. This invention offers many new and exciting opportunities to improve the internal combustion engine. From superior cooling capabilities, significant reduction in capital equipment cost and an increased ease in maintenance and repair-ability, these engine designs offer both the producer and the user a great value. With lighter weight, these designs provide for higher fuel efficiency and economy. The interchangeability of parts of this invention as well as the No Machining Required design, significantly reduces parts inventories and the cost of service and repair. Manufacturing cost is also greatly reduced with these designs. Casting failures are virtually eliminated and production is faster and cheaper. With the use of interchangeable front and rear assemblies, different rated engines can be produced with the same components simply by adding cylinders. A 3 cylinder lower block can accommodate either an in-line 3 or a V6 upper block. A 4 cylinder lower block can accommodate either an in-line 4 or a V8 upper block. This process can continue right up to a 10 cylinder lower block accommodating either an in-line 10 or a V20 upper block. The lower blocks will work with both 60 degree V and 90 degree V style upper blocks. Die casting of major parts such as the lower and upper block will reduce cost, and the benefits of short path perpendicular cooling will reduce failures. Finally, the tapered design of the cylinder head where it mates with the intake and exhaust manifolds, allows for the easy removal of an individual cylinder without removal or even loosening of bolts on adjacent cylinders. This will make the work go smoother and faster. Down time will be reduced, inventories will be reduced, operating cost will be reduced, the carbon footprint of production will be reduced, shipping weights will be reduced, warranty cost will be reduced, production cost will be reduced and last but not least, emissions will be reduced.

BRIEF DESCRIPTION OF THE DRAWINGS

The drawings constitute a part of this specification and include exemplary embodiments to the invention which may be embodied in various forms. It is to be understood that in some instances various aspects of the invention may be shown exaggerated or enlarged to facilitate an understanding of the invention.

FIG. 1: is a drawing of the left side of a complete internal combustion engine invention as would be used in a marine application. Changes in manifolds would allow for use in other engine applications.

Figure 2:
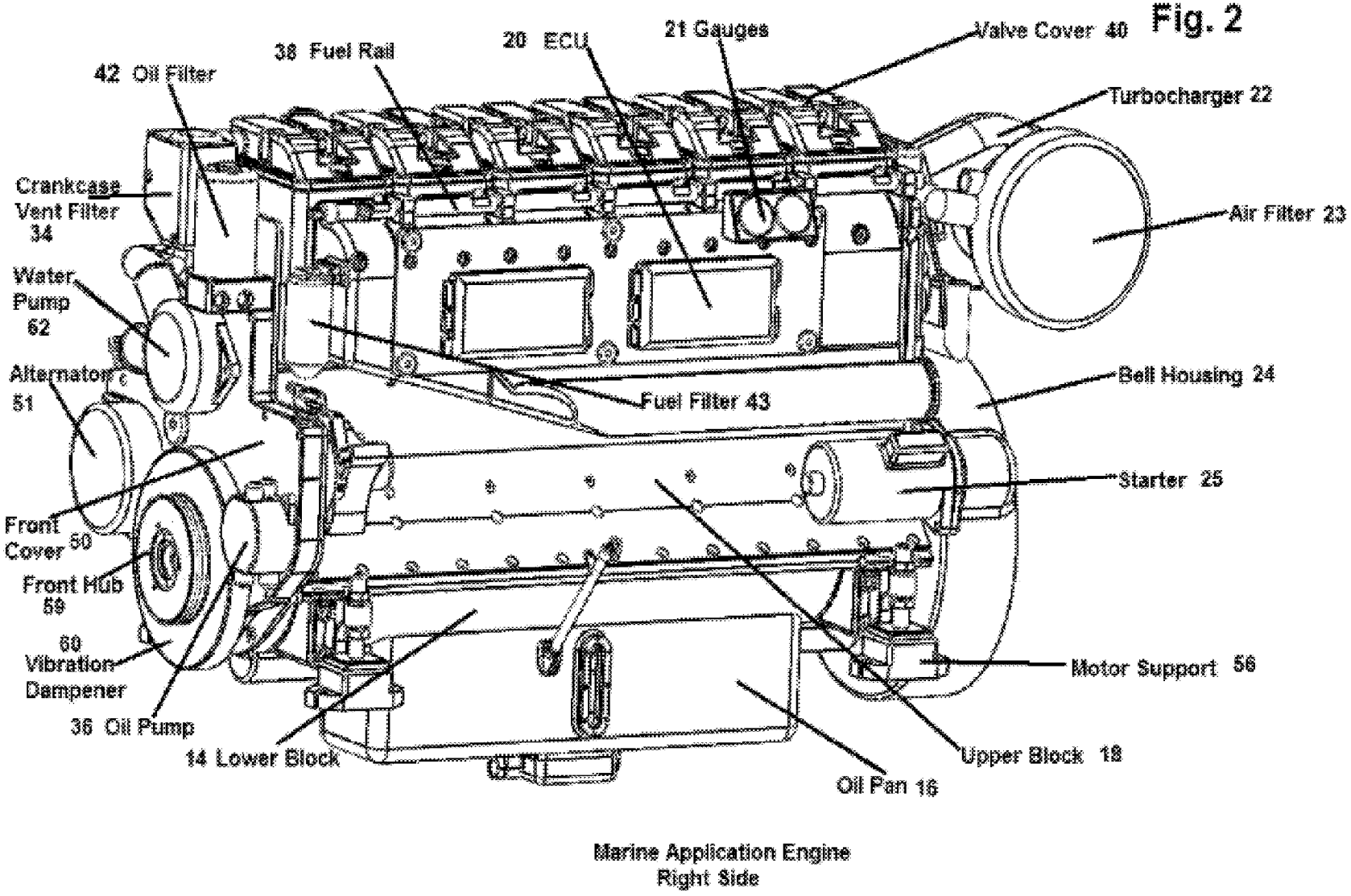
FIG. 2: is a drawing of the right side of a complete internal combustion engine invention as would be used in a marine application. Changes in manifolds would allow for use in other engine applications.

The following drawing number legend is used with the appended drawings.

4—60 Degree V Style Upper Block
6—90 Degree V Style Upper Block
10—Complete IC Engine
14—Lower Block (interchangeable)
16—Oil Pan
17—Manifold Cooling Water Outlet
18—In-Line Upper Block
19—Cooling Water Supply Port
20—Engine Electronic Control Unit (ECU)
21—Gauges
22—Turbocharger
23—Air Filter
24—Bell Housing
25—Starter
26—Exhaust Manifold (marine application)
27—Intake Manifold (marine application)
28—Flywheel
30—Radiator Cap
31—Heat Exchanger Tube Pack (for marine application)
32—Oil Dipstick
34—Crankcase Ventilation Filter
36—Oil Pump
38—Fuel Rail
40—Valve Cover
42—Oil Filter
43—Fuel Filter
44—Oil Filter Base
46—Oil Full Cap
48—Front Plate
50—Front Cover
51—Alternator
54—Motor Mount
56—Motor Support
57—Crankshaft Pin
58—Crankshaft
59—Front Hub
60—Vibration Dampener
62—Water Pump
64—Cylinder Head
65—Fuel Injector
66—Cylinder Jug (sometimes referred to as cylinder barrel)
67—Cylinder Jug Water Jacket
70—Coolant Water Manifold (Bolt On)
74—Camshaft
75—Camshaft Pocket Cover
78—Camshaft Bearing
80—Upper Main Bearing Housing
81—Bearing Housing Rib
84—Lower Main Bearing Housing
86—Main Bearing Half
88—Main Bearing Bulkhead
92—Mounting Rail
96—Locating Surfaces (for main journal housings)
100—Indexing Slots (for main journal housings)
104—Lower Locating Surface (for main journal housing)
112—Indexing/Mating Surface A
114—Indexing/Mating Surface B
124—Indexing/Mating Surface C
132—Hinge Pin
136—Hinge Pivot
138—Hinge Mounting Slots
140—Hinge Pivot Pin Bore
152—Connecting Rod
153—Connecting Rod Balancing Post
154—Connecting Rod Splayed Con-rod Bolt (inserted from the top)
155—Connecting Rod Cap Split Line
156—Connecting Rod Cap
157—Rod Cap Angled Mating Surface
158—Wristpin
160—Piston
166—Cylinder Seal
168—Cylinder Sleeve
169—Cylinder Sleeve Indexing Flat Side
170—Cylinder Sleeve Oil Spray Slot
172—Oil Spray Jets (for wristpin and piston cooling)
175—Oil Galley
176—Oil Drain Passage (machined in cylinder jug)
177—Oil Funnel (top of connecting rod)
178—Cylinder Jug Oil Spray Slot
180—Piston Oil Spray Slot (slot through piston to allow oil spray to reach con-rod oil funnel and wristpin)
184—Sleeve Oil Weep Holes (to lubricate piston skirt)
200—Cylinder Head and Manifold Tapered Mating

DETAILED DESCRIPTION

Detailed descriptions of the preferred embodiment are provided herein. It is to be understood, however, that the present invention may be embodied in various forms, land based, marine based or aviation. Therefore, specific details disclosed herein are not to be interpreted as limiting, but rather as a basis for the claims and as a representative basis for teaching one skilled in the art to employ the present invention in virtually any appropriately detailed system, structure or application. While the invention has been described in connection with a preferred embodiment, it is not intended to limit the scope of the invention to the particular form set forth but, on the contrary, it is intended to cover such alternatives, modifications, and equivalents as may be included within the spirit and scope of the invention as defined by the appended claims.

Thus, the primary object of the invention is to provide a multi-cylinder internal combustion engine which utilizes a component construction which is split along horizontal, vertical and diverse lines to the axis of the crankshaft.

Another object of the invention is to provide an engine of the above character which utilizes a unitized cylinder jug and cylinder sleeve wherein the cylinder jug and sleeve can be individually replaced.

Yet another object of the invention is to provide an engine of the above character which facilitates attachment of the cylinder head with bolts through the cylinder jug and then into the engine upper block.

Another object of the invention is to provide an engine of the above character having improved cooling capabilities, particularly in the vicinities of the cylinder jug and the cylinder head.

Another object of the invention is to provide an engine of the above character having improved cooling capabilities, particularly in the vicinities of the cylinder jug where the coolant flow is perpendicular to the crankshaft rather than parallel.

Another object of the invention is to provide an engine of the above character having improved cooling capabilities, particularly in the vicinities of the cylinder head where the coolant flow is perpendicular to the cylinder jug coolant flow and also perpendicular to the crankshaft, rather than parallel.

Another object of the invention is to provide an engine of the above character having improved oiling capabilities, particularly in the area where the piston contacts the cylinder wall and where the wristpin contacts the connecting rod.

Another object of the invention is to improve piston and wristpin cooling through the use of redundant oil sprays that are perpendicular to the piston movement.

Still yet another object of the invention is to provide an engine of the above character which has a highly efficient water supply manifold for cooling of the engine.

Another object of the invention is to provide an engine of the above character which can be utilized in conjunction with land, marine or aviation use and either spark or compression ignition engines.

Still yet another object of the invention is to provide an engine of the above character which will operate on liquid or gaseous fuels.

Yet another object of the invention is to provide an engine of the above character which can be readily and easily assembled and disassembled in the field or in the shop.

Another object of the invention is to provide an engine of the above character which can be constructed from conventional materials that differ in weight and rate of heat transfer.

Another object of the invention is to provide a multi-cylinder internal combustion engine of the above character which can be assembled or repaired using interchangeable parts suitable for fitting on any number of cylinder engines of an engine family, whether inline or V-type arrangement.

A further object of the invention is to provide a multi-cylinder internal combustion engine of the above character which is simple and economical to construct and repair.

Yet another object of the invention is to provide a multi-cylinder internal combustion engine of the above character which is comprised of a minimum number of different parts and of lightweight construction.

Still yet another object of the invention is to provide a multi-cylinder internal combustion engine of the above character which is of vertical and horizontal split cylinder and block construction of several angles and permitting the assembly of the engine by the joining of the several standardized interchangeable parts.

Another object of the invention is to provide a multi-cylinder internal combustion engine of the above character which is formed of die cast sections or parts bolted together to form the complete engine.

Another object of the invention is to provide a multi-cylinder internal combustion engine of the above character in which each cylinder jug and head is separately and independently water cooled.

A further object of the invention is to provide a multi-cylinder internal combustion engine of the above character which has a straight through push rod construction.

Another object of the invention is to provide a multi-cylinder internal combustion engine of the above character which allows for greater volumes of intake air flows through higher boosting.

Another object of the invention is to provide a multi-cylinder internal combustion engine of the above character which has improved engine combustion efficiency, economy, and reduced pollutant emissions.

Another object of the invention is to provide a lower block that will never need to be removed from the application during repairs.

Another object of the invention is to provide an engine that never needs to be removed or transported to a machine shop for repair.

Another object of the invention is an engine where all parts are replaceable quickly and easily in the field.

Another object of the invention is an upper block that is both removable and also tilts either right or left for easy access to the crankshaft and other lower end components.

Another object of the invention is a lower block design that utilizes several angles where the lower block and the upper block mate, therefore allowing both in-line and V style upper blocks to be used without mechanical interference.

Yet another object of the invention is a lower and upper block design that utilizes several angles or indexing surfaces where it mates to the upper or lower block therefore increasing the rigidity and durability of the lower and upper block components.

Another object of the invention is an angular mating of the upper block to the lower block that allows easy installation and removal of the attaching bolts for both in-line and V style application rather than a vertical bolt insertion where installation and removal of the bolts in a V style application would not be possible.

Another object of the invention is an engine that requires no line boring during the manufacturing process.

Yet another object of the invention is an engine that requires no line boring during the repair process.

Another object of the invention is a tapered cylinder head, tapered where the cylinder head mates to the intake and exhaust manifold in order to facilitate the easy removal and replacement of an individual cylinder without affecting other cylinders or parts.

Yet another object of the invention is an engine of which all parts can be removed through a small opening thereby eliminating the need for the destruction of areas that might enclose the engine.

Another object of the invention is the use of a splayed connecting rod bolt application so that the split mating surfaces are not in-line as with the prior art, but at an angle to one another.

Another object of the invention is the use of a splayed connecting rod bolt application so that the connecting rod cap bolts can be more easily installed and removed.

Another object of the invention is the use of splayed mating surface machining so that the mating surfaces are not in-line as with the prior art, but at an angle to each other, eliminating any movement of the connecting rod cap.

Other objects and advantages of the present invention will become apparent from the following descriptions taken in connection with the accompanying drawings, wherein, by way of illustration and example, an embodiment of the present invention is disclosed.

In accordance with a preferred embodiment of the invention, there is disclosed an internal combustion engine of modular construction comprising: a modular construction using interchangeable parts; a lower and upper block; individual cylinder jug(s) and cylinder head(s); individual separate cylinder jug(s) with individual and separate cylinder sleeve(s) mounted on a common upper block; individual separate cylinder head(s) mounted on and bolted through individual separate cylinder jug(s); individual separate cylinder head cover(s) mounted on individual separate cylinder head(s); individual separate cylinder jug(s) each with its own separate coolant jacket and separate coolant intake from a common rail delivery source and separate exit to its own separate cylinder head; a perpendicular to the crankshaft flow of coolant through the cylinder jug(s); individual separate cylinder head(s) each with its own separate coolant intake from its separate cylinder jug and separate exits to a wet exhaust manifold; individual separate cylinder heads with coolant flow that is perpendicular to the cylinder jug coolant flow and also perpendicular to the crankshaft; a conventional in-block camshaft that is removable from the front, back or side of the engine; a conventional flat tappet or roller lifter and pushrod design; a perpendicular to crankshaft intake and exhaust valve rocker arm construction; an upper and lower block construction where the upper block (either in-line or V) can be either removed completely or tilted left or right to allow easy access to the crankshaft and main bearings as well as other lower end components; an internal combustion engine with multiple mating angles of the upper and lower block, which increases rigidity and allows lighter materials to be utilized. Further, this engine invention is an internal combustion engine where no line boring is required during the manufacturing process or the repair process. Further, it is an internal combustion engine with improved oiling capabilities such as redundant oil sprays and a special cylinder sleeve design that allows spraying oil through the sleeve to oil the wristpin and connecting rod as well as an oil drain down with weep holes to lubricate the piston skirt. Finally, the current invention offers a connecting rod design that allows for easy installation and removal of the connecting rods from the top of the engine without interference.

Figure 3:
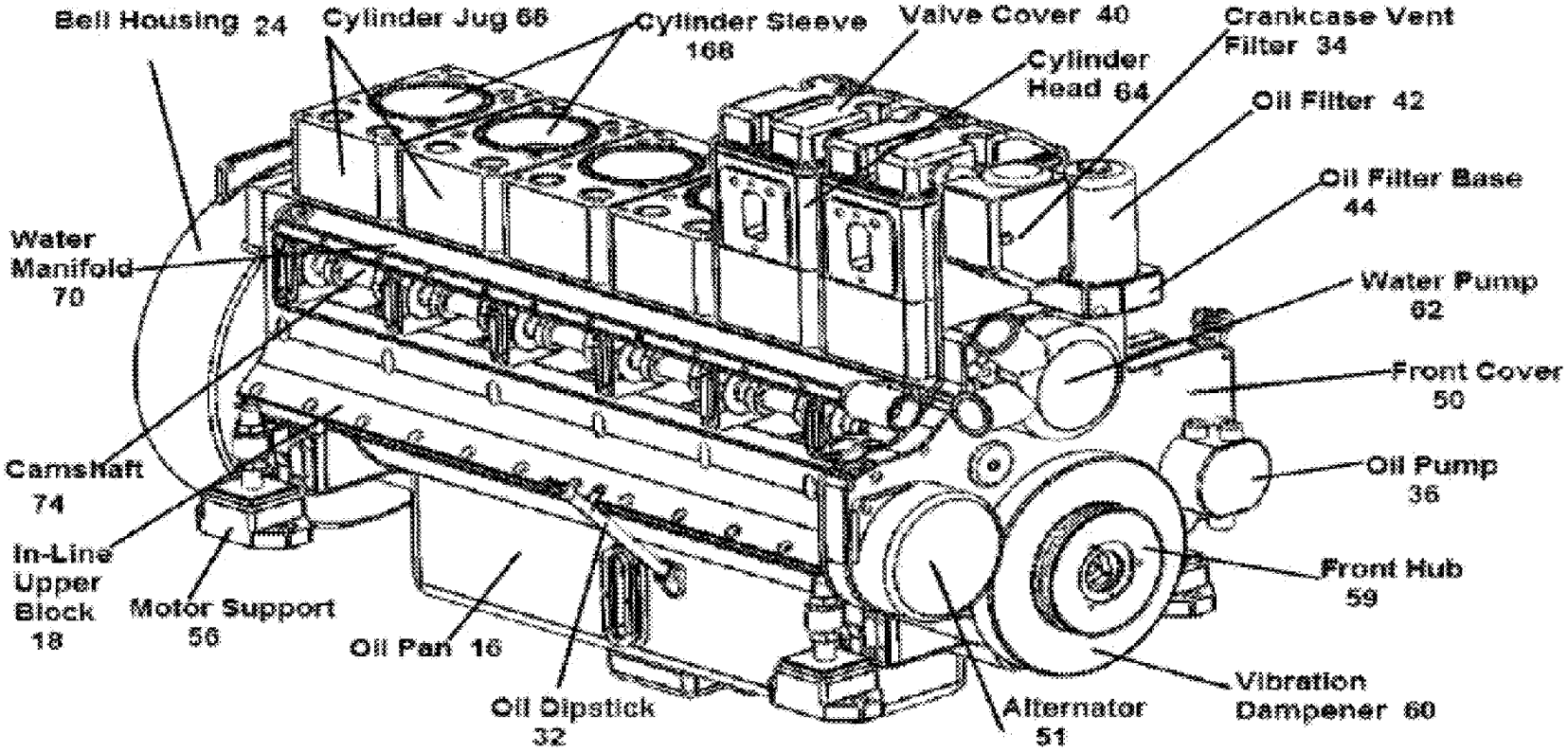
FIG. 3: is a drawing of the modular engine invention with parts removed and showing upper and lower blocks, individual cylinder jugs and cylinder heads and camshaft side pocket.
Figure 4:
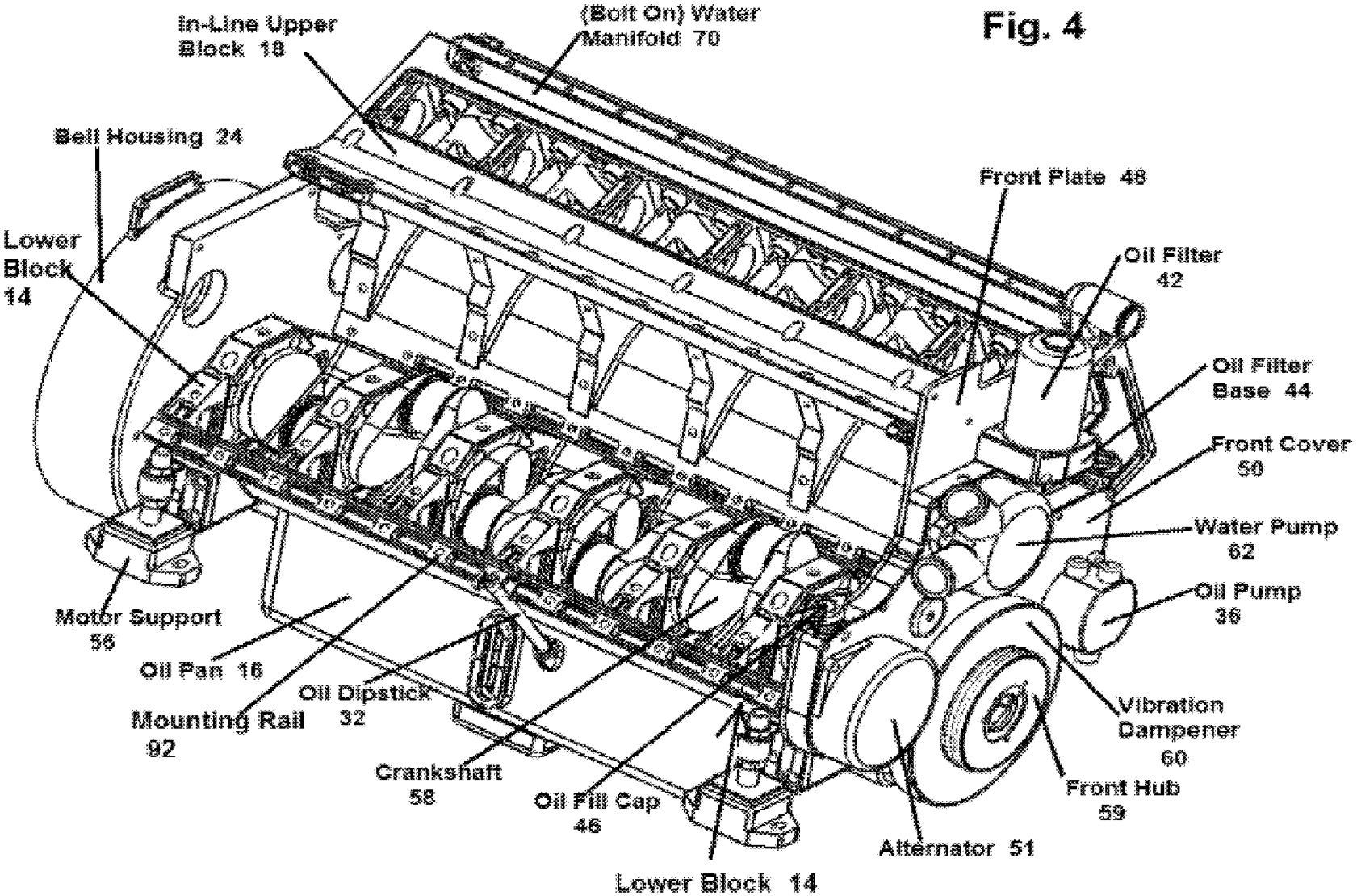
FIG. 4: is a drawing of the front left view of the modular engine invention with the upper in-line block in the tilted position and with cylinder jugs, cylinder heads, connecting rods and pistons removed.
Figure 5:
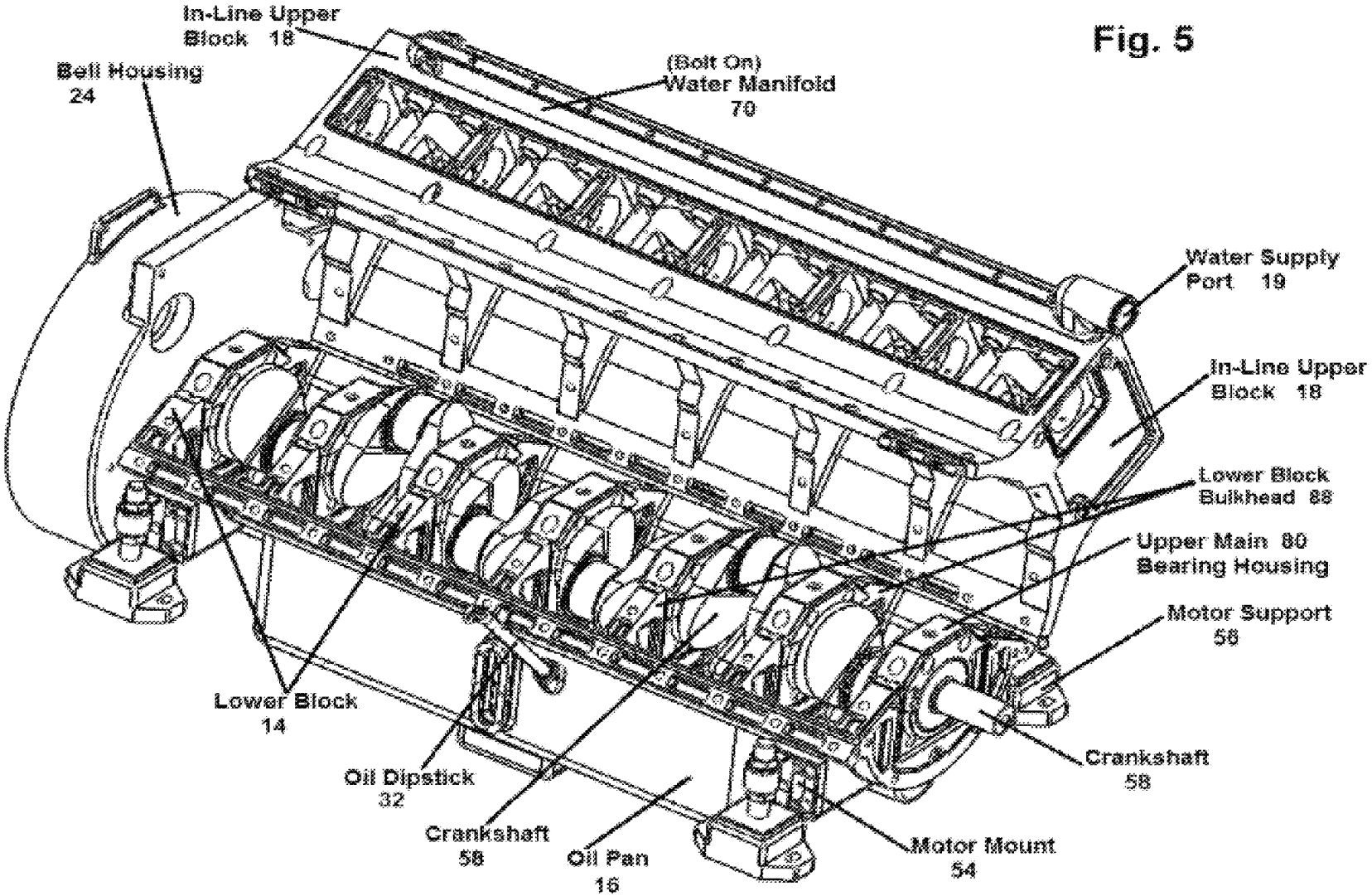
FIG. 5: is a drawing of the front left view of the modular engine invention with the upper block in the tilted position with parts removed including the front end assemblies.
Figure 6:
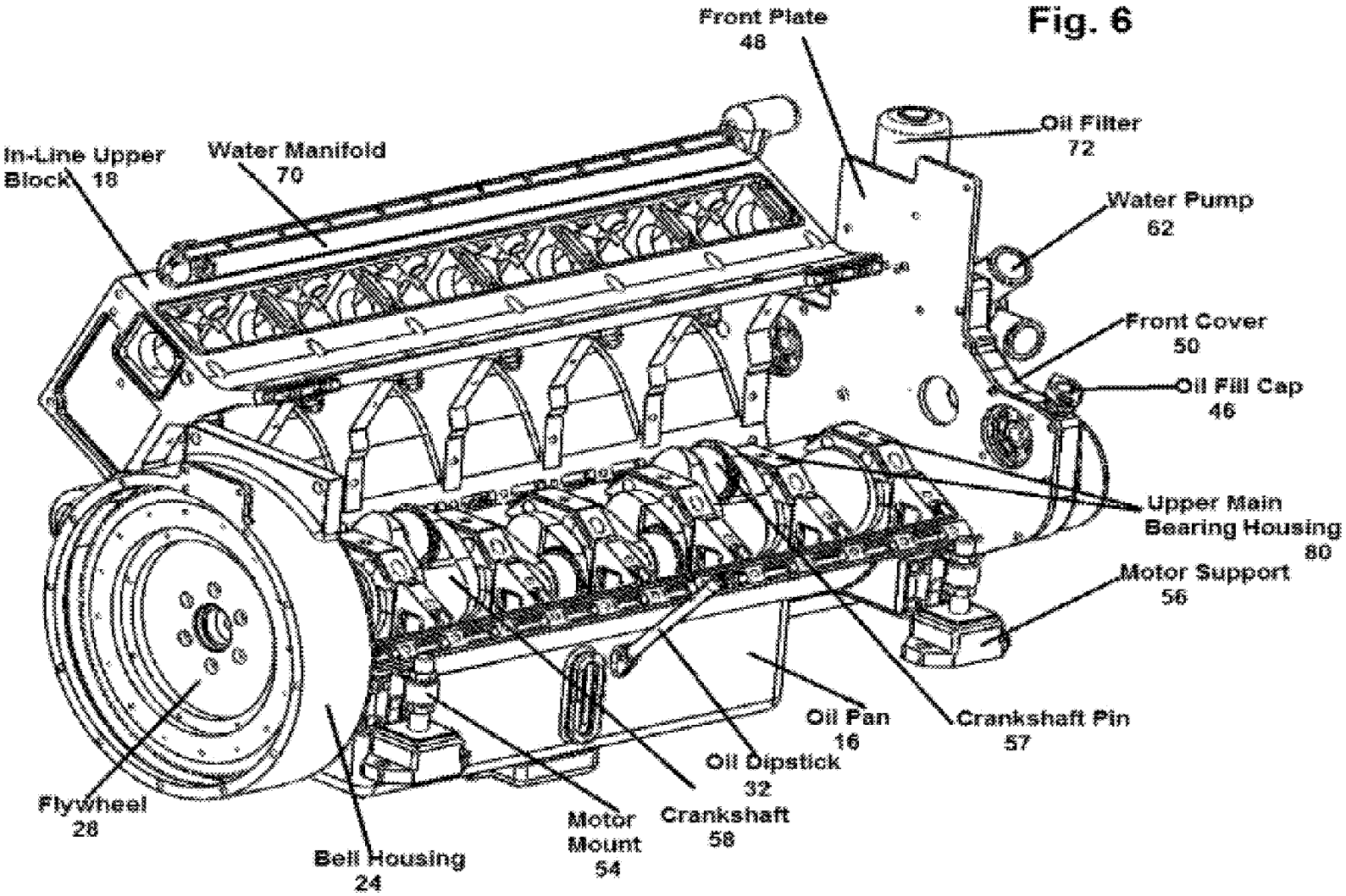
FIG. 6: is a drawing of the rear right view of the modular engine invention with the in-line upper block in the tilted position with parts removed.
Figure 7:
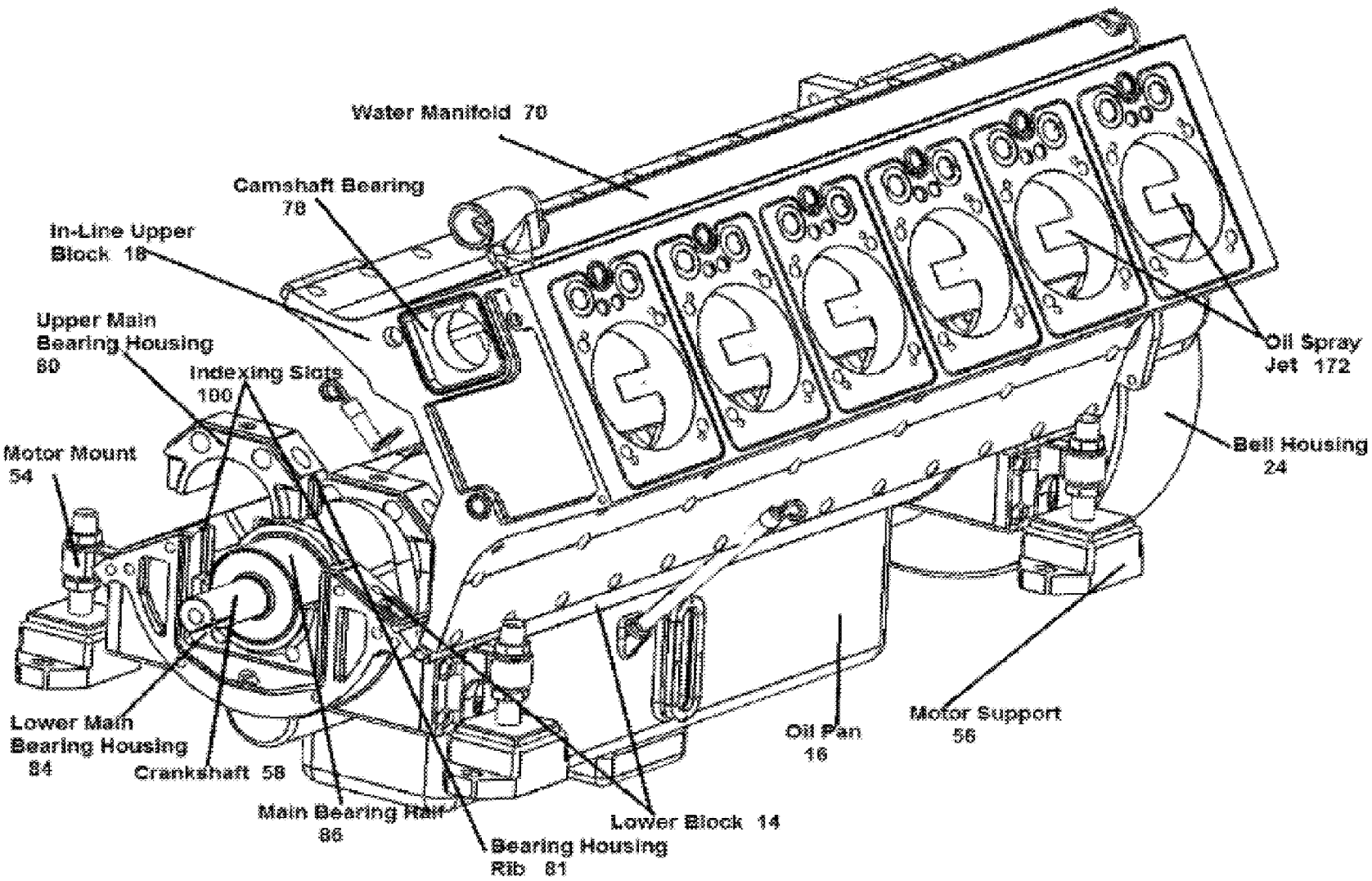
FIG. 7: is a drawing of the front right view of the modular engine invention with the upper block in the tilted position and the front engine assemblies removes.
Figure 8:
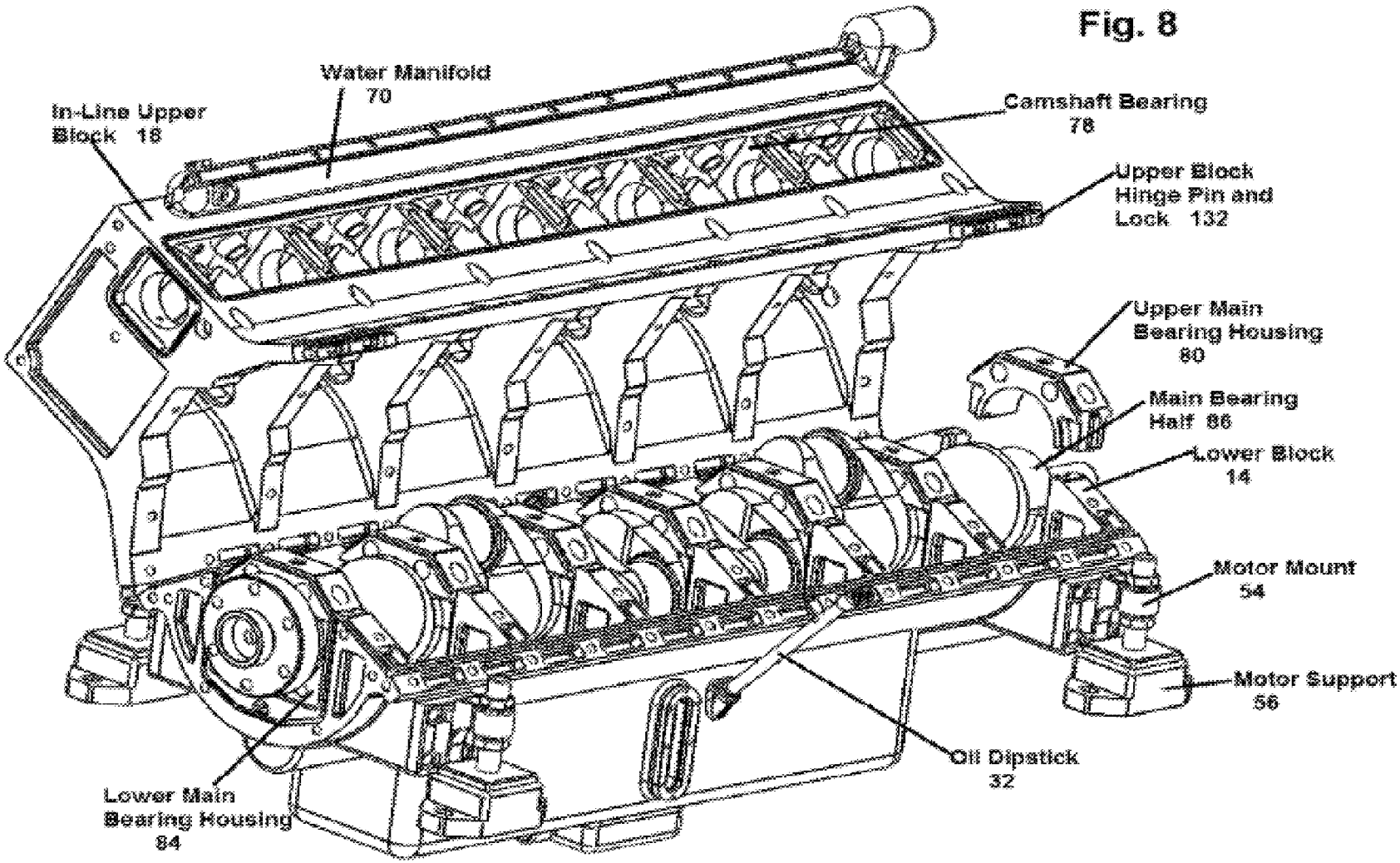
FIG. 8: is a drawing of the right rear view of the modular engine invention with both the front and rear assemblies removed and the in-line upper block in the tilted position.
Figure 9:
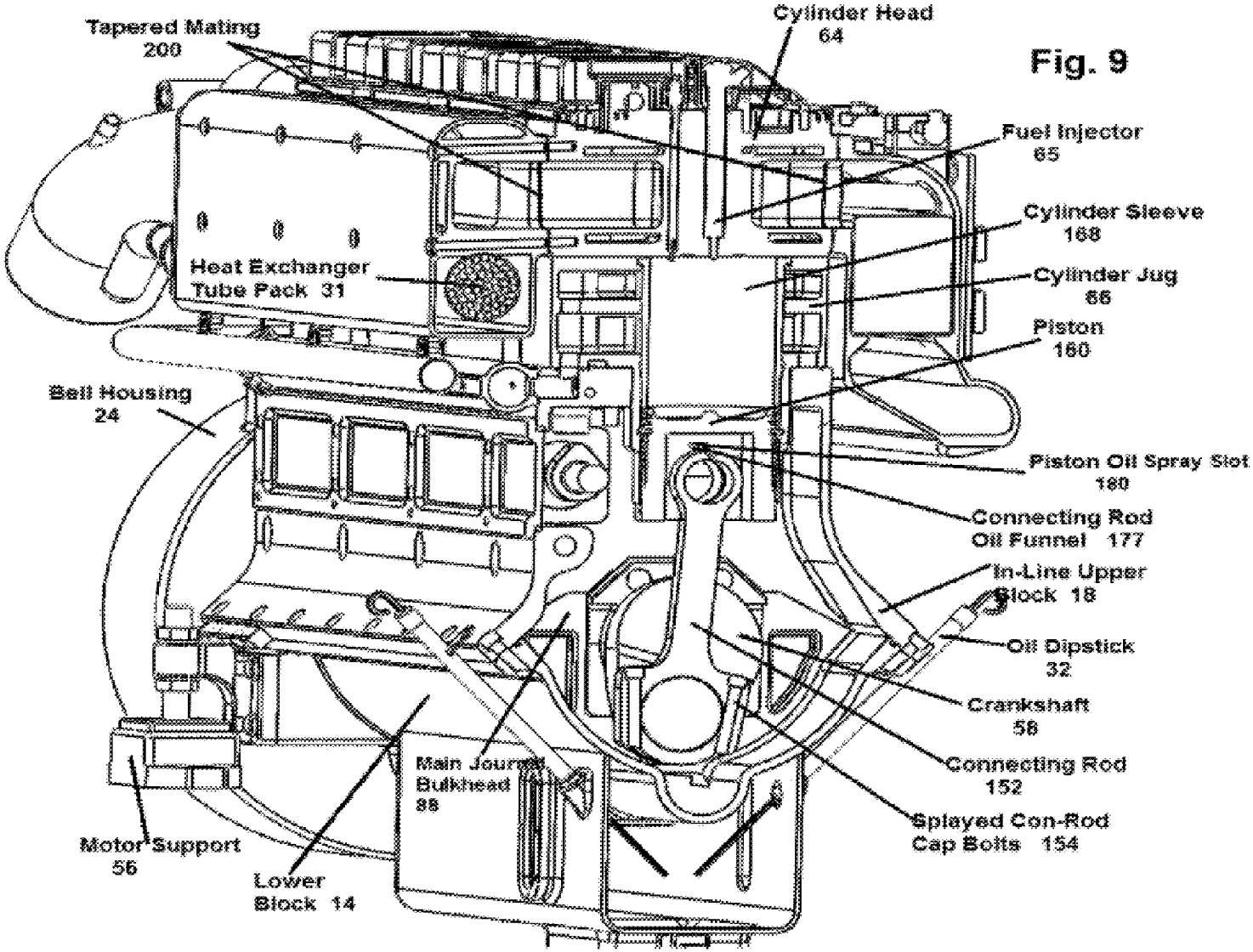
FIG. 9: is a drawing of a cutaway view of the modular engine invention that shows the upper block mated to the lower block along with cylinder jug, cylinder head, piston and connecting rod.
Figure 10:
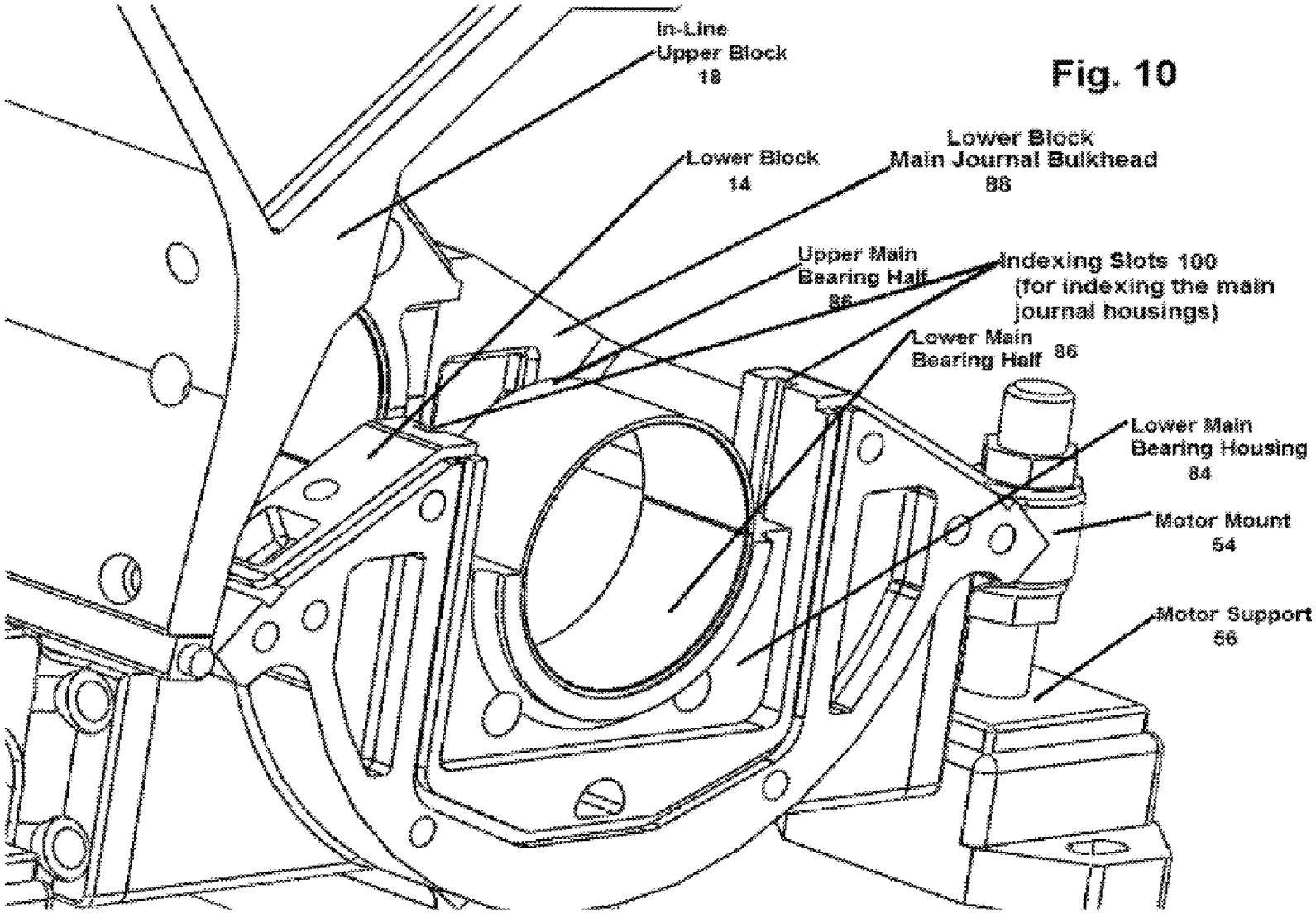
FIG. 10: is a drawing of the front or rear view of the modular engine invention with the in-line upper block in the tilted position. The upper block can tilt either right or left.

FIG. 1 shows the invention as a marine application with marine intake and exhaust manifolds. Land based or aviation applications are easily produced using appropriate intake and exhaust manifold configurations. This drawing is of a six cylinder engine. As shown in FIG. 1, internal combustion engine #10 is based upon an interchangeable lower block, 14, which may be employed with a variety of engine configurations such as the inline 6 cylinder illustrated in FIG. 1, or other configurations such as the V-block engines shown in FIGS. 15 and 16. Because the lower block #14 is interchangeable, allowing a single design to support both in-line and V-block engines, both inventory and production costs are reduced. In this drawing you can see the wet exhaust manifold #26 that forms as a collector for the coolant as it is discharged from each individual cylinder head. The coolant outlet #17 from the exhaust manifold is where piping would connect in other applications to carry coolant to a heat exchange device such as a radiator (not shown). The marine version uses an integral tube pack heat exchanger #31 (not visible) that is located in the bottom of the marine exhaust manifold #26. The (bolt on) water manifold #70 carries the chilled coolant to the individual cylinder jug(s) as supplied by the coolant pump #62. The water manifold inlet #19 is connected to the discharge side of the coolant pump #62, by the use of hoses or pipes (not shown). In other applications the radiator or heat exchange device would be connected to the suction side of the coolant pump #62 via hoses or pipes (not shown). FIG. 1 also shows other engine parts such as upper block #18, providing a mounting structure for a plurality of cylinder jugs and cylinder heads. Engine #10 also includes turbocharger #22 attached to exhaust manifold #26, as well as bell housing #24, radiator cap #30, crankcase vent filter #34, oil filter #42, and front cover #50. Engine #10 further includes front hub #59 and vibration dampener #60. Motor supports #56, support the engine #10 as well as provide vibration reduction. The upper block #18, of one piece die cast design, can be constructed of different materials such as aluminum, iron or blended alloys. This upper block #18 can be of in-line or V design and forms the support member for the camshaft as well as the cylinder jug(s) and cylinder head(s). The front mounting plate #48, the front gear cover #50, alternator #51, oil pump #36, valve cover #40, air cleaner #23, camshaft cover #75 and oil pan #16 are also depicted. FIG. 2 is similar to FIG. 1 except that it is a view from the front right side of the engine. The drawing shows all the components normally associated with an internal combustion engine including the oil pan #16, the oil pump #36, the starter #25, the fuel filter #43, the oil filter #42, the bell housing #24, the electronic control unit or ECU #20, water pump #62, crankcase vent filter #34, alternator #51, front cover #50, front hub #59, motor support #56, bell housing #24, air filter #23, turbocharger #22, valve cover #40, gauges #21, and the fuel rail #38. This drawing also depicts less conventional parts such as the in-line upper block #18 and the lower block #14. FIG. 3 is a broken down view of the modular engine invention showing the individual cylinder jugs #66 and the individual cylinder heads #64. The individual cylinders are cooled by coolant being supplied by the water manifold #70. The camshaft pocket cover #75 (see FIG. 1) is removed (not visible) to expose the camshaft #74. Firstly, camshaft #74 may be withdrawn axially through the front of the engine. Secondly, camshaft #74 may be withdrawn axially from the rear of the engine through a port provided in the bell housing #24. Finally, camshaft #74 may be withdrawn laterally from the side of the engine by simply unbolting camshaft bearing(s) #78 (see FIG. 7) and then removing camshaft #74 and camshaft bearing(s) #78 as an assembly. The ability to easily remove camshaft #74 promotes servicing of the engine within the confined spaces frequently encountered in many engine applications. Other indicated parts include the cylinder sleeve #168, valve cover #40, crankcase vent filter #34, oil filter #42, oil filter base #44, water pump #62, front cover #50, oil pump #36, front hub #59, vibration dampener #60, alternator #51, oil dipstick #32, oil pan #16, motor support #56 and in-line upper block #18. FIG. 4 is a front left side view of the modular engine invention that shows the in-line upper block #18 in the tilted position exposing the crankshaft #58. In this view, a number of the parts have been removed for improved viewing. The angular mating surfaces are clearly visible in this view. It is also plainly visible that the in-line upper block #18 can be tilted over without removal of the front or rear components of the engine invention. FIGS. 4, 5, 6, 7 and 8, illustrate the details of the maintainability-enhancing block tilt feature built into the present engine. These figures show upper block #18 tilted upwardly and away from lower block #14, with the tilting being oriented about an axis generally defined by one of the mounting rails #92. Once upper block #18 has been tilted to the position shown in these figures, the main bearings of crankshaft #58 may be serviced without removing crankshaft #58 from the lower engine block #14. It is anticipated that crankshaft #58 will be mounted using conventional bearing inserts for both upper and lower riding surfaces or it may be mounted using a lower bearing insert between the crankshaft #58 and the lower main bearing housing and a direct contact upper main bearing housing. The latter method should eliminate a spun bearing failure. The front end assemblies are also depicted including the front hub #59, front dampener #60, oil pump #36, alternator #51, front cover #50, front plate #48, water pump #62, oil filter #42, and oil filter base #44. The rear assembly includes the bell housing #24 with other parts being the motor support #56, oil pan #16, oil dipstick #32 and oil fill cap #46. FIG. 5 is similar to FIG. 4 except that the front end assemblies have been removed. The crankshaft #58 along with the upper main journal housing #80 and the water manifold #70 are depicted. The main journal housings interlock into the lower block #14 to eliminate movement and can be manufactured in aluminum or other alloys that provide better heat transfer. The lower block #14 supporting parts include the motor support #56 and motor mount #54. Other parts visible are the oil pan #16, oil dipstick #32, bell housing #24, in-line upper block #18, water supply port #19 and the lower block bulkheads #88. FIG. 6 is a drawing that shows the modular engine invention in a disassembled state with the in-line upper block #18 in the tilted position. The upper block can be tilted to either side of the engine invention or removed completely. This view is from the right rear side and shows the bell housing #24 as well as the flywheel #28. The drawing also depicts the water manifold #70 as well as showing how the in-line upper block #18 can be tilted without interfering with the front or rear end assemblies, including the front plate #48 and the bell housing #24. A rear view of the front end assemblies shows the front plate #48, front cover #50, oil fill cap #46, oil filter #72 and the water pump #62. Other parts in the drawing include the motor mount #54, motor support #56, oil pan #16, oil dipstick #32, crankshaft #58, and crankshaft pin #57. FIG. 7 is a right front view of the modular engine invention showing the in-line upper block #18 in the tilted position with an exploded view of the upper main bearing housing #80 as well as the lower main bearing housing #84. The main bearing housing rib(s) #81 is plainly displayed. The main bearing housing rib(s) #81 indexes into the indexing slots #100 of the lower block #14. The multiple interlocking features applied to the upper and lower bearing housings prevent the bearing housings from squirming due to combustion loads, particularly with highly boosted engines. This prolongs bearing life and reduces mechanical engine noise. The bearing indexing system also allows replacement of the upper and lower main bearing housings without any added machining The interchangeable six cylinder lower block #14 is shown as well as the water manifold #70 and the main bearing half #86. The camshaft bearing #78 is also visible. The oil spray jets #172 are depicted within the upper block #18. The support components for the lower block #14 are shown also, motor mount #54 and motor support #56. Other displayed components consist of crankshaft #58, a main bearing half #86 the oil pan #16 and the bell housing #24. FIG. 8 is the right side rear view of the modular engine invention with the in-line upper block #18 in a tilted position with exploded view of the upper main bearing journal housing #80 and the lower main bearing journal housings #84. The cylinder jugs #66 (see FIG. 3) and cylinder heads #64 (see FIG. 3) have been removed along with the front and rear assemblies. The angular mating surfaces of the upper and lower block are clearly visible. The water manifold #70 is visible and bolted along the top of the upper block #18. This manifold delivers coolant to the individual cylinders. The hinge pin #132 is pictured and it is upon this hinge that the upper block pivots. The lower block #14 is supported by the motor mount #54 and the motor support #56. The camshaft bearing #78 and the main bearing half #86 are also displayed. FIG. 9 is a cutaway view of the internal components of the modular engine invention. The multiple mating angles and lines of the in-line upper block #18 and its angular contact with the lower block #14, are clearly visible along the lower block main journal bulkhead(s) #88. FIG. 9 is a sectional view through one cylinder of the present inventive engine. Crankshaft #58 is connected to the lower end of connecting rod #152 which is fastened to crankshaft #58 by splayed connecting rod cap bolts #154. Note that bolts #154 are attached from the top of the engine and angled outwardly for easier installation and removal. This design permits power piston #160 and connecting rod #152 to be removed from crankshaft #58 without removing any portion of lower block #14 or any portion of the upper block #18. The piston oil spray slot #180 and the connecting rod oil funnel #177 are depicted as well. The fuel injector #65 is shown, along with the cylinder sleeve #168. The tapered mating feature is indicated on the drawing by the tapered mating #200. This tapered surface located on the cylinder head #64 mates with the intake and exhaust manifold to allow for easy removal of the cylinder head #64 and cylinder jug #66, without affecting the other cylinders. FIG. 10 is a close up view of the end of the modular engine invention with the crankshaft removed. The main journal bearing halves #86 (upper and lower) along with the lower main journal bearing housing #84 are clearly displayed. The indexing slots #100, for the insertion of the upper and lower bearing housings, are also visible. Ribs located on the bearing journal housings are inserted into the indexing slots #100 in order to prevent lateral movement or squirming of the bearing housings and to maintain perfect position. The in-line upper block #18 is tilted open and displays the angular mating with lower block #14. The lower block supporting parts, motor mount #54 and motor support #56, are also displayed.

Figure 11:
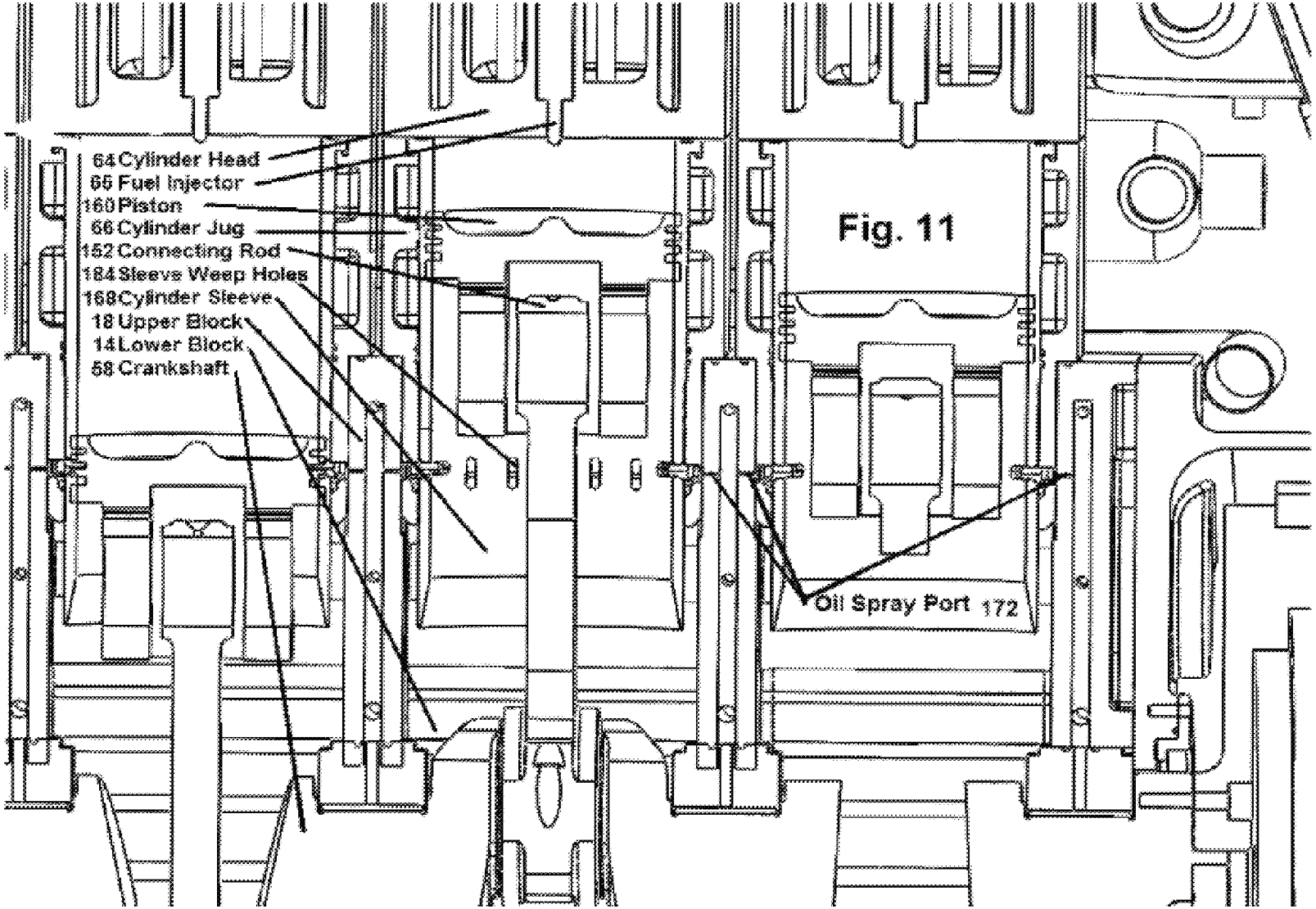
FIG. 11: is a drawing of a longitudinal cutaway view of the center line of the modular engine invention showing internal components.
Figure 12:
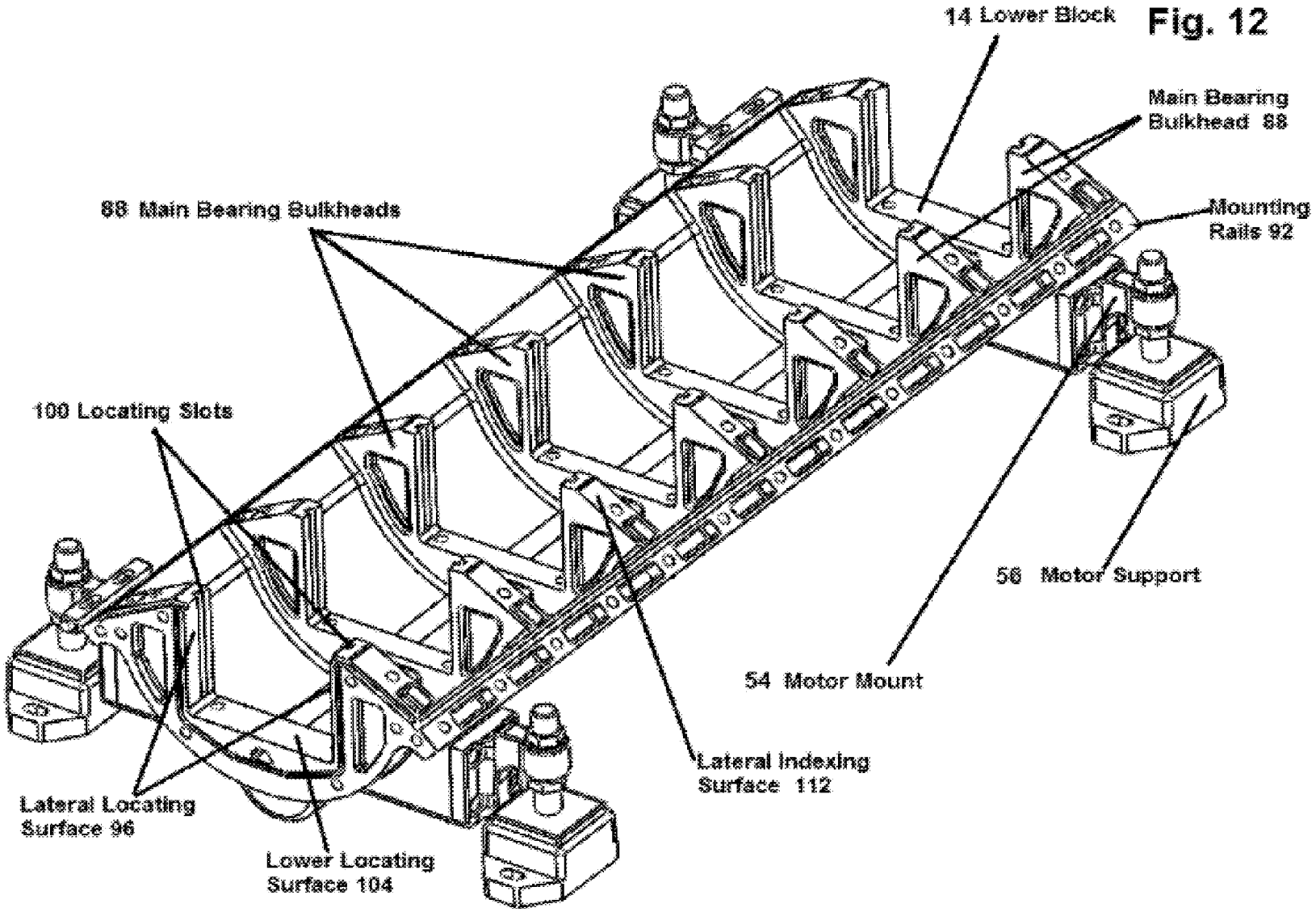
FIG. 12: is a drawing of the six cylinder lower block sitting on the mounts with the oil pan removed.
Figure 13:
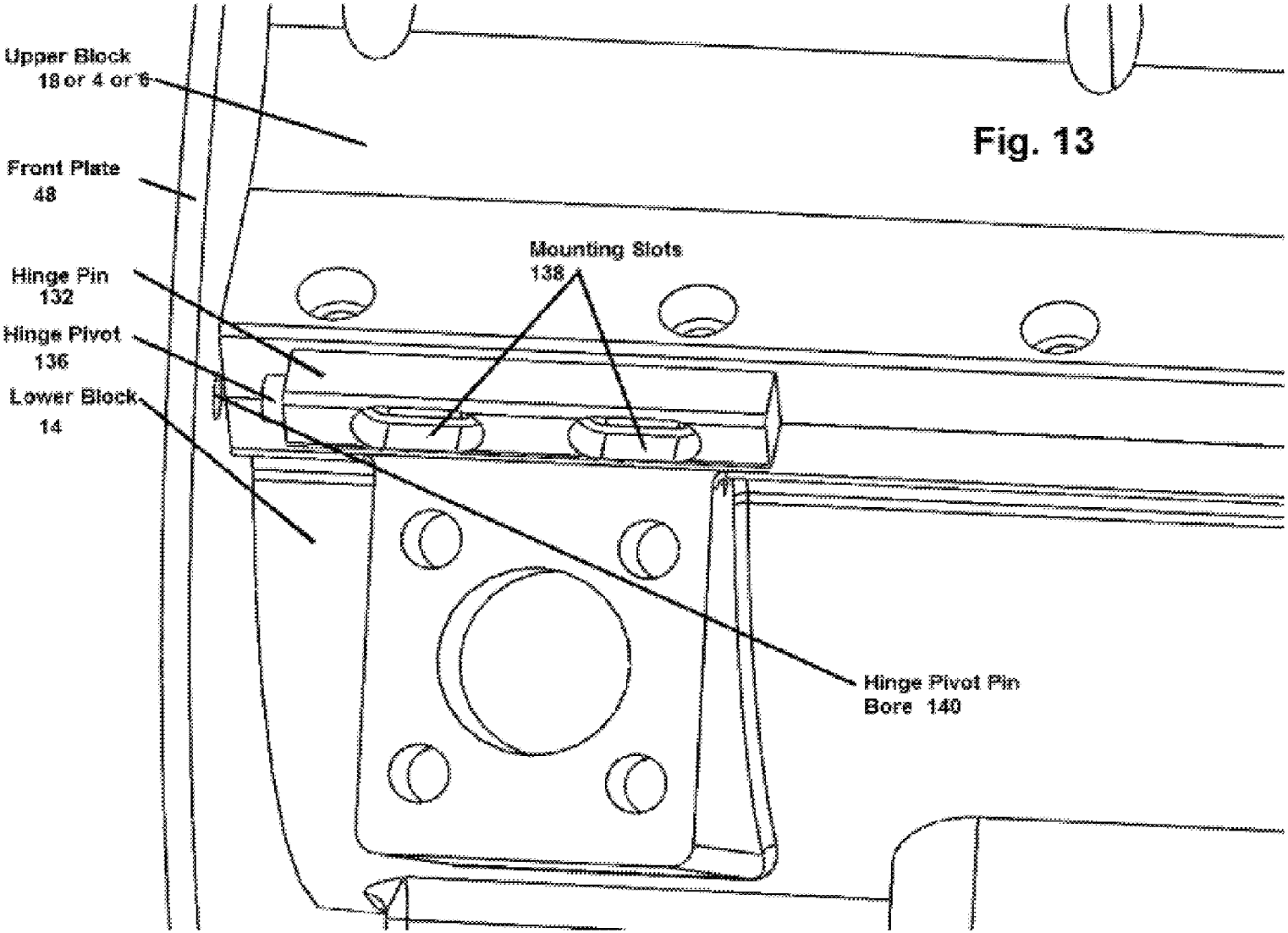
FIG. 13: is a drawing that shows the hinge mechanism that allows the upper block to tilt over.

FIG. 11 is a close up longitudinal cutaway view of the internal components of the modular engine invention. The redundant oil spray ports #172 along with the cylinder sleeve weep holes #184 are plainly visible. The oil spray ports #172 are created by drilling through the upper block bulkhead(s) and through the oil galley #175 (see FIG. 19). Other components such as the fuel injector #65, piston #160 and the cylinder sleeve #168 are also shown. Maintaining an abundant supply of oil to lubricate the wristpin and cool the piston is a primary benefit of the present invention. The oil spray ports #172, located in the upper block #18, spray oil through the cylinder jug #66, further through the cylinder sleeve #168 and further through the piston #160. This oil lubricates and cools the piston #160, wristpin #158 (see FIG. 24), connecting rod #152 and cylinder sleeve #168. The lower block #14, as well as the crankshaft #58, is also depicted. FIG. 12 is a drawing of the interchangeable lower block#14 as it sits on the motor supports #56 and motor mounts #54. The locating slots #100 that index the upper and lower main journal housings are plainly visible. The locating slots #100 index the main journal housings (upper and lower) longitudinally. The main bearing bulkheads #88 are also plainly displayed. The indexing lower locating surface #104 locates the bottom of the lower main journal housing #84 (not shown, see FIG. 7). The lateral locating surfaces #96 indexes the left and right sides of the upper main journal housing #80 (not shown, see FIG. 7) and the lower main journal housing #84 (not shown, see FIG. 7). The mounting rail #92 is where the upper block bolts to the lower block #14 and the lateral indexing surface #112 positions the upper block. FIG. 13 is a drawing of the hinge pin #132 as it is installed on the upper block. The adaptability and ease of use of the present upper block tilting system is promoted by the hinge mechanism illustrated in FIGS. 13 and 14. Hinge pin #132 has a pivot section #136 which may be used to preferentially engage a suitable supporting structure at either end of the engine. Hinge pin #132 is fixable or moveable in place by a plurality of fasteners (not shown) inserted into any upper block through mounting slots #138. Suitable structures for mounting hinge pins 132 include, without limitation, bell housing #24 (not shown) and front plate #48. For example, in FIG. 13, hinge pin bore #140 is shown in front plate #48 and the same bore can be provided in the bell housing #24 (not shown) as well. In corresponding FIG. 14, the hinge pin is shown as having been pushed into engagement with bore #140 prior to insertion of fasteners (not shown) through mounting slots #138. Location of hinge pin

Figure 14:
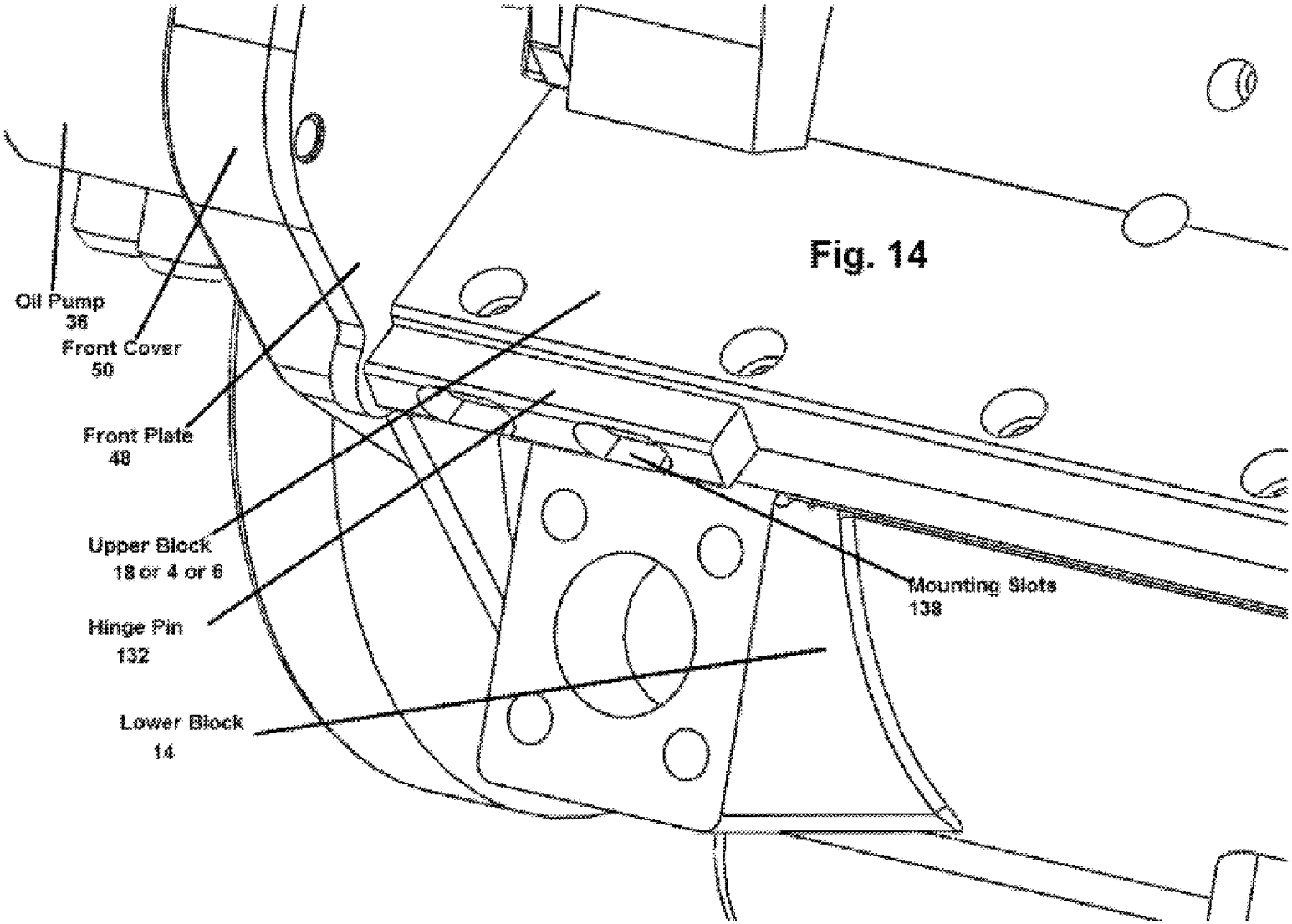
FIG. 14: is a drawing of the hinge mechanism with the hinge pin inserted into the pivot position.
Figure 15:
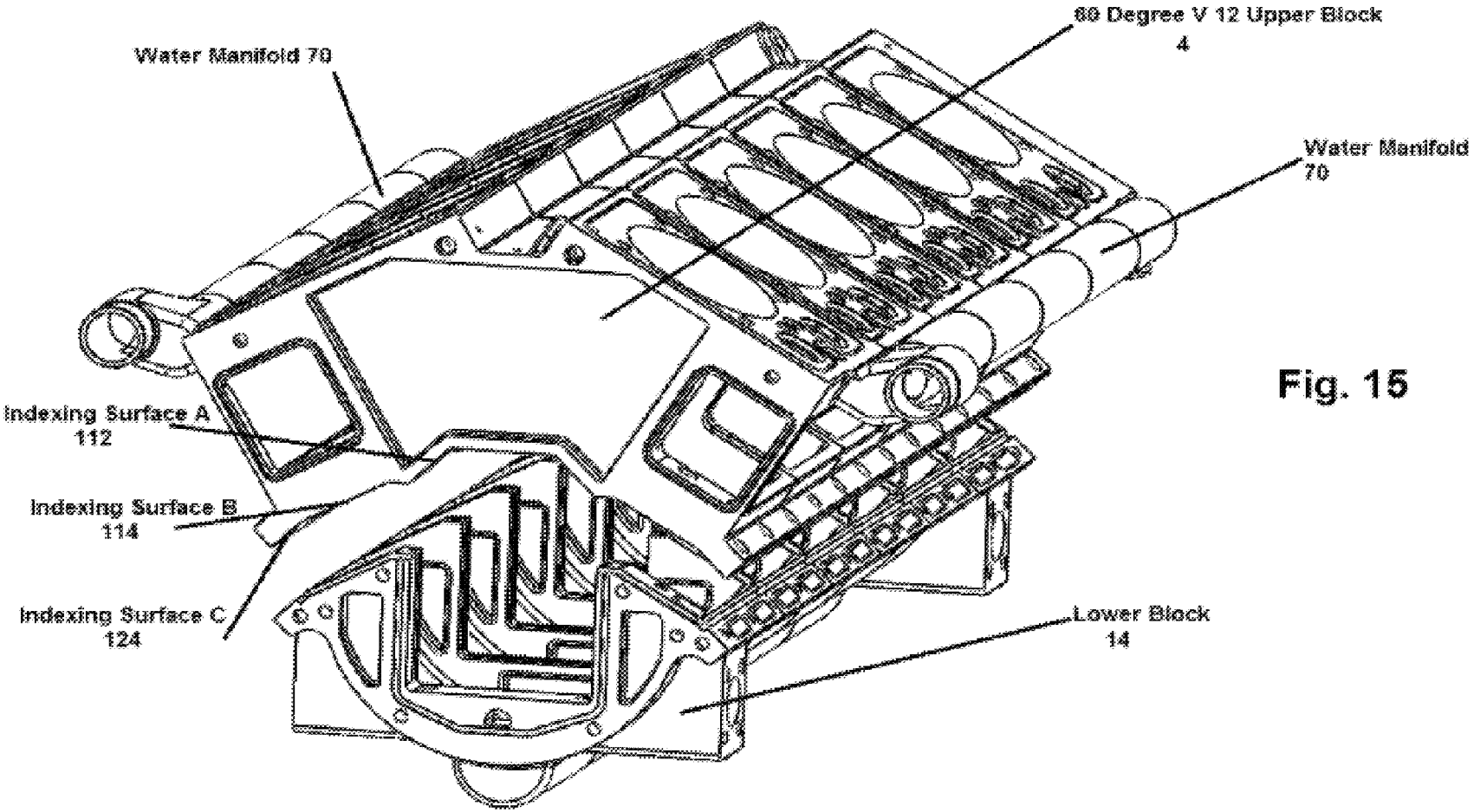
FIG. 15: is a drawing of a 60 degree V twelve style upper block positioned over the common six cylinder lower block.

#132 in the place shown in FIG. 14 permits upper block #18 to be tilted about the axis of hinge pin #132. Those skilled in the art will appreciate, in view of this disclosure, that two hinge pins, one at each end of the engine, will generally be employed to establish a pivot axis between upper block #18 and lower block #14. This hinge pin #132 works for any of the upper block applications for all in-line and V style upper blocks. FIG. 14 is the same as FIG. 13 but in FIG. 14 the hinge pin #132 is engaged with the front plate #48. The hinge pin #132 utilizes the hinge pin slots #138 in order for the hinge pin #132 to slide on the bolts into the hinge position. The hinge pin #132 pivots on pivot pin bore #140 located in the front plate #48 and the bell housing #24 (not shown). The hinge turns on the hinge pivot #136 when it is inserted in the hinge pivot pin bore #140. The mounting slots #138 allow the hinge pin #132, to remain on the mounting bolts and still be slid into the hinge pivot pin bore #140. The hinge pivot pin #132 is interchangeable for either the front plate #48 or the bell housing #24 (not shown). The oil pump #36 is also displayed. FIG. 15 shows the modular engine invention with a 60 degree V12 style upper block #4 positioned above the interchangeable (6 cylinder) lower block #14.

Figure 25:
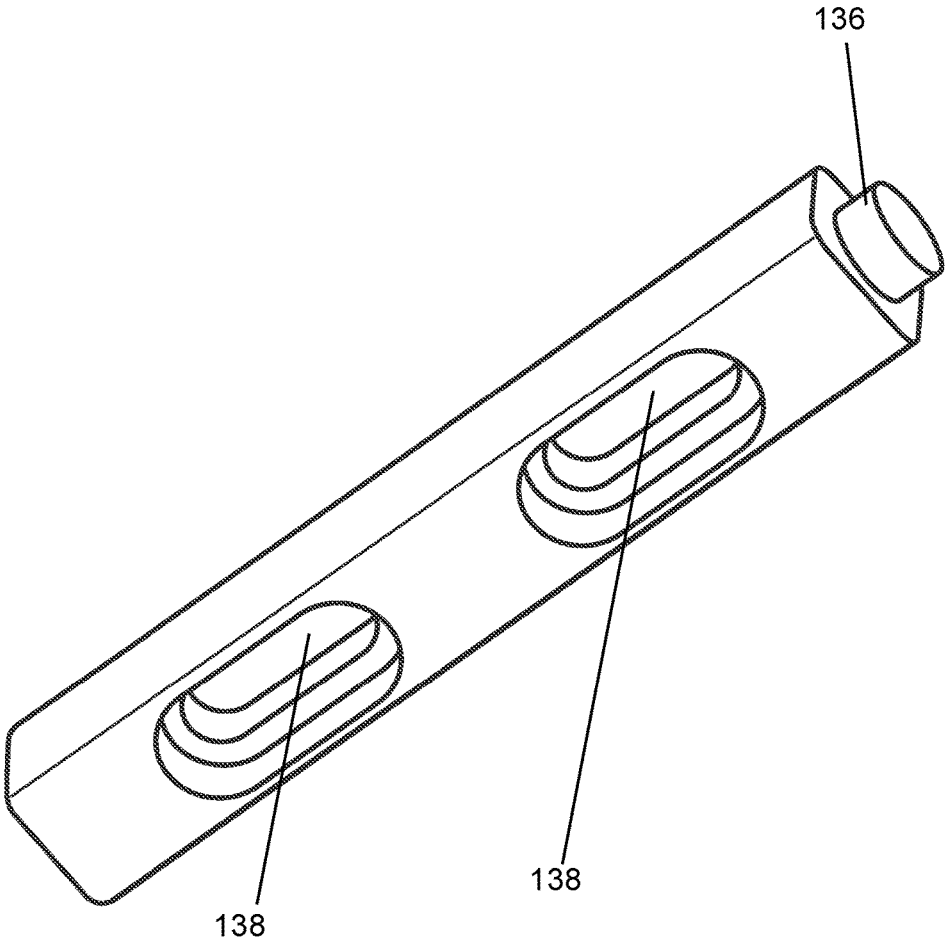
FIG. 25 is a perspective view of a hinge pin.

FIG. 25 shows a hinge pin#132, including two hinge mounting slots#138 and a hinge pivot#136.

Additional view of the hinge pin#132 and related components are shown in other figures for this application. FIG. 5 shows two hinge pins#132 on the raised portion of the in-line upper block#18. A hinge pivot#136 is visible extending from the engaged portion of the in-line upper block#18. A hinge pivot pin bore#140 in the bell housing#24 is visible as the hinge pin#132 is on the raised portion of the in-line upper block#18 and not in use to provide the axis of rotation.

FIG. 6 shows two hinge pins#132 on the raised portion of the in-line upper block#18. The opposite hinge pivot pin bore#140 in the front plate#48 is visible as the hinge pin#132 is on the raised portion of the in-line upper block#18 and not in use to provide the axis of rotation.

FIG. 7 shows two hinge pins#132 on the raised portion of the in-line upper block#18. FIG. 7 also shows the rear hinge pins#132 and the hinge pivot#136 that are serving as the axis of rotation for the rotation of the in-line upper block#18.

FIG. 8 shows two hinge pins#132 on the raised portion of the in-line upper block#18. FIG. 8 also shows the hinge pivot#136 that is serving as part of the axis of rotation for the rotation of the in-line upper block#18.

FIG. 10 shows the hinge pivot#136 and hinge pin#132 that is serving as part of the axis of rotation for the rotation of the in-line upper block#18.

FIG. 12 shows the hinge pins#132 that were made visible when the in-line upper block#18 was rendered invisible although the hinge pins# are in position to serve as the axis of rotation for an attached in-line upper block#18. This view shows the hinge mounting slots#138 as the hinge mounting slots#138 would face the in-line upper block#18.

Figure 17:
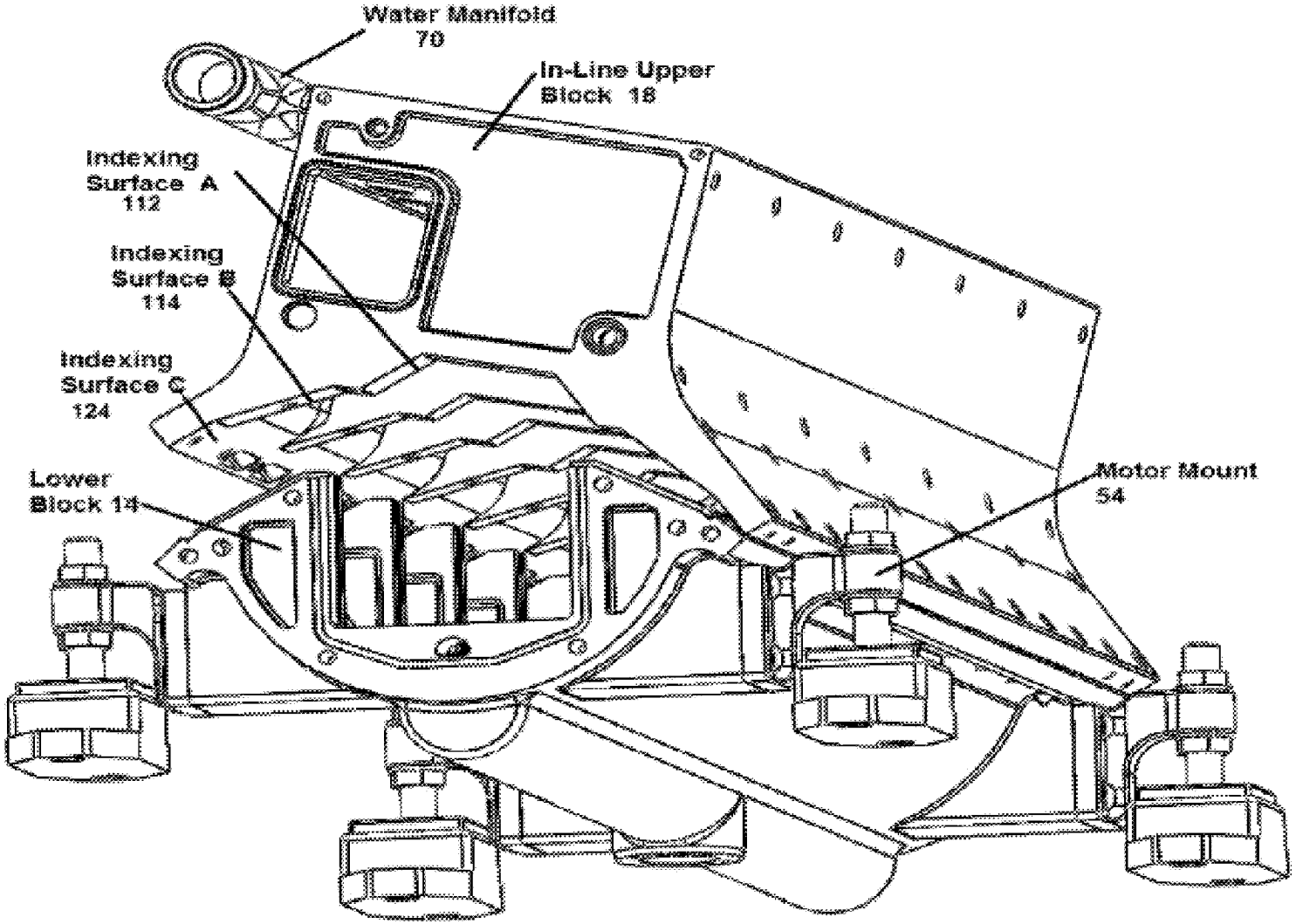
FIG. 17: is a drawing of an in-line six cylinder upper block positioned over the common six cylinder lower block.

FIG. 17 shows bores#144 that are in the in-line upper block#18 and receive the fasteners that connect hinge pins#132 to the in-line upper block#18 through hinge mounting slots#138.

Figure 26:
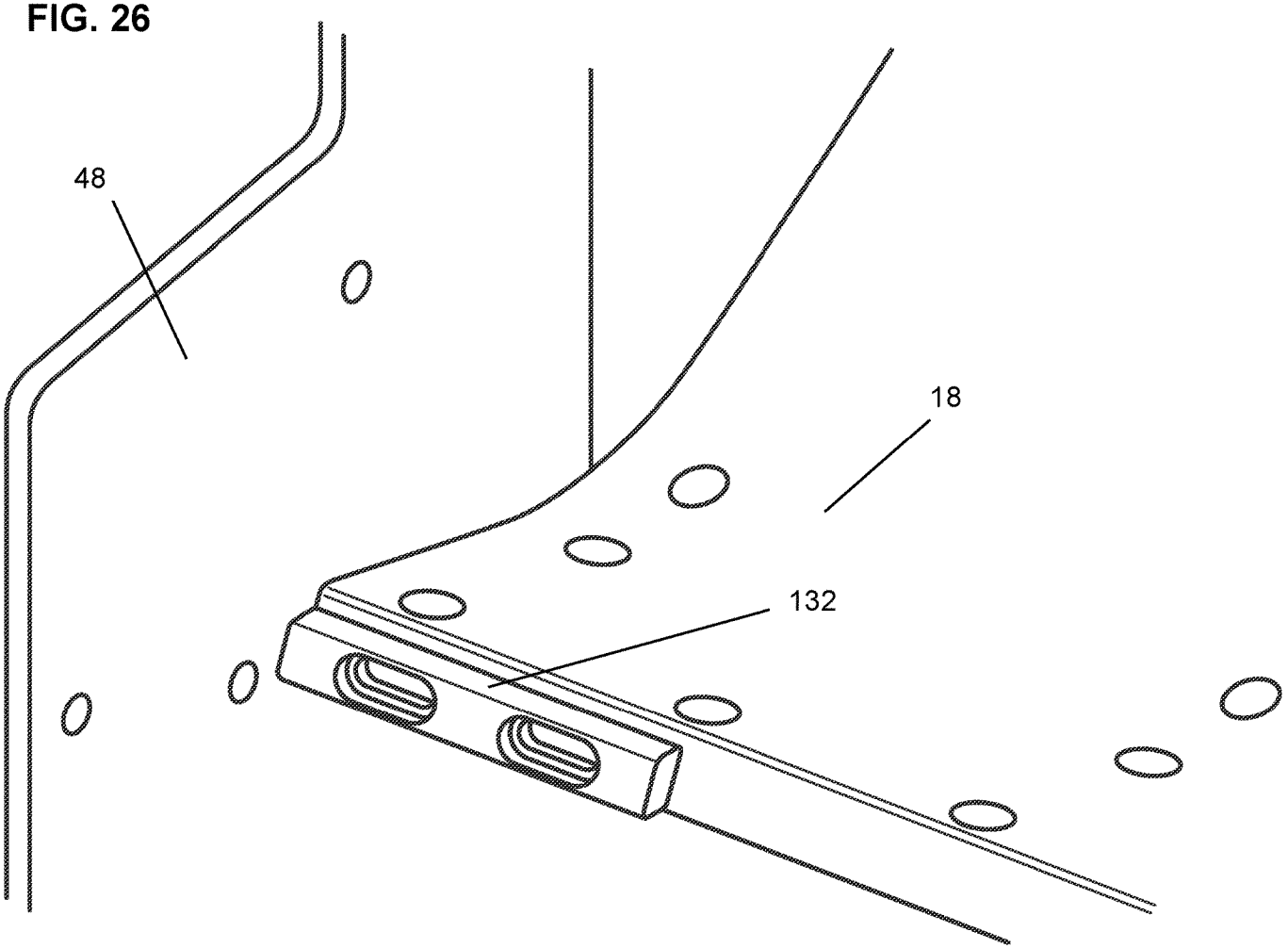
FIG. 26 shows a tilted in-line upper block shown in a retained position by an interaction of the hinge pin with a bore in front plate.

FIG. 26 shows a tilted in-line upper block#18 shown in a retained position as the hinge pin#132 as hinge pivot#136 (not visible here) is inserted into a bore (not visible here) in front plate#48.

Figure 16:
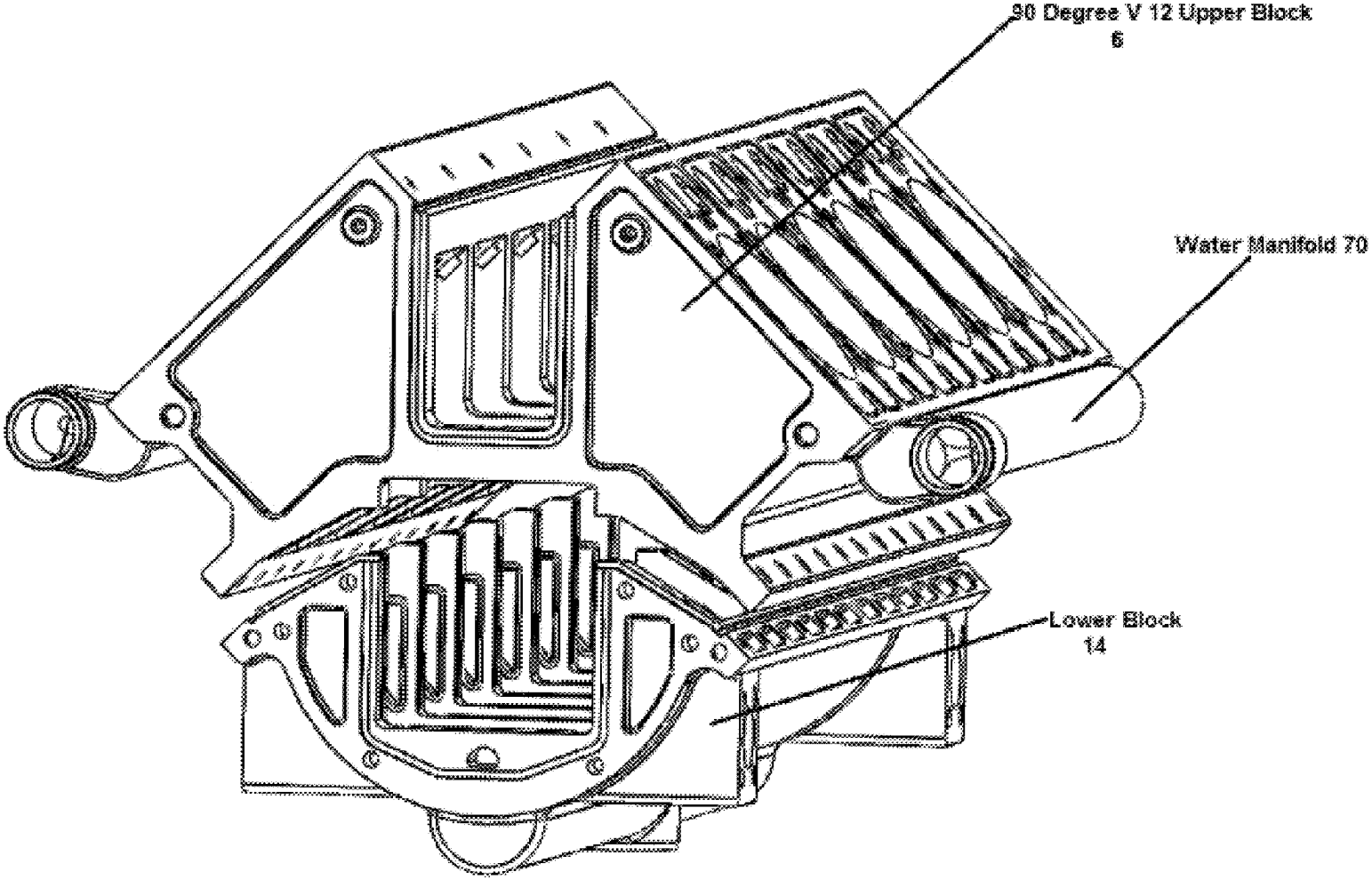
FIG. 16: is a drawing of a 90 degree V twelve style upper block positioned over the common six cylinder lower block

FIGS. 15 and 16 are further evidence of the versatility of the present engine system inasmuch as the illustrated 60 and 90 degree upper blocks may be employed with a lower block #14 having a common design. As noted above, this reduction in complexity will inure to the benefit of the engine manufacturer, and perhaps more importantly, to the end user of the engine, given the concomitant reduction in the number of different spare parts required to maintain a family of engines employed to power different types of machines. The angular mating surfaces between the lower and upper block are plainly visible. The drawing shows primary indexing surface A #112, Indexing surface B #114 and indexing surface C #124 as related to the mating surfaces on the lower block #14. The water manifold #70 that supplies coolant to the individual cylinders is also displayed. FIG. 16 is similar to FIG. 15 except that it shows the modular engine invention with a 90 degree V12 style upper block #6 positioned above the same (6 cylinder) lower block #14. The water manifold #70 is also seen.

Figure 18:
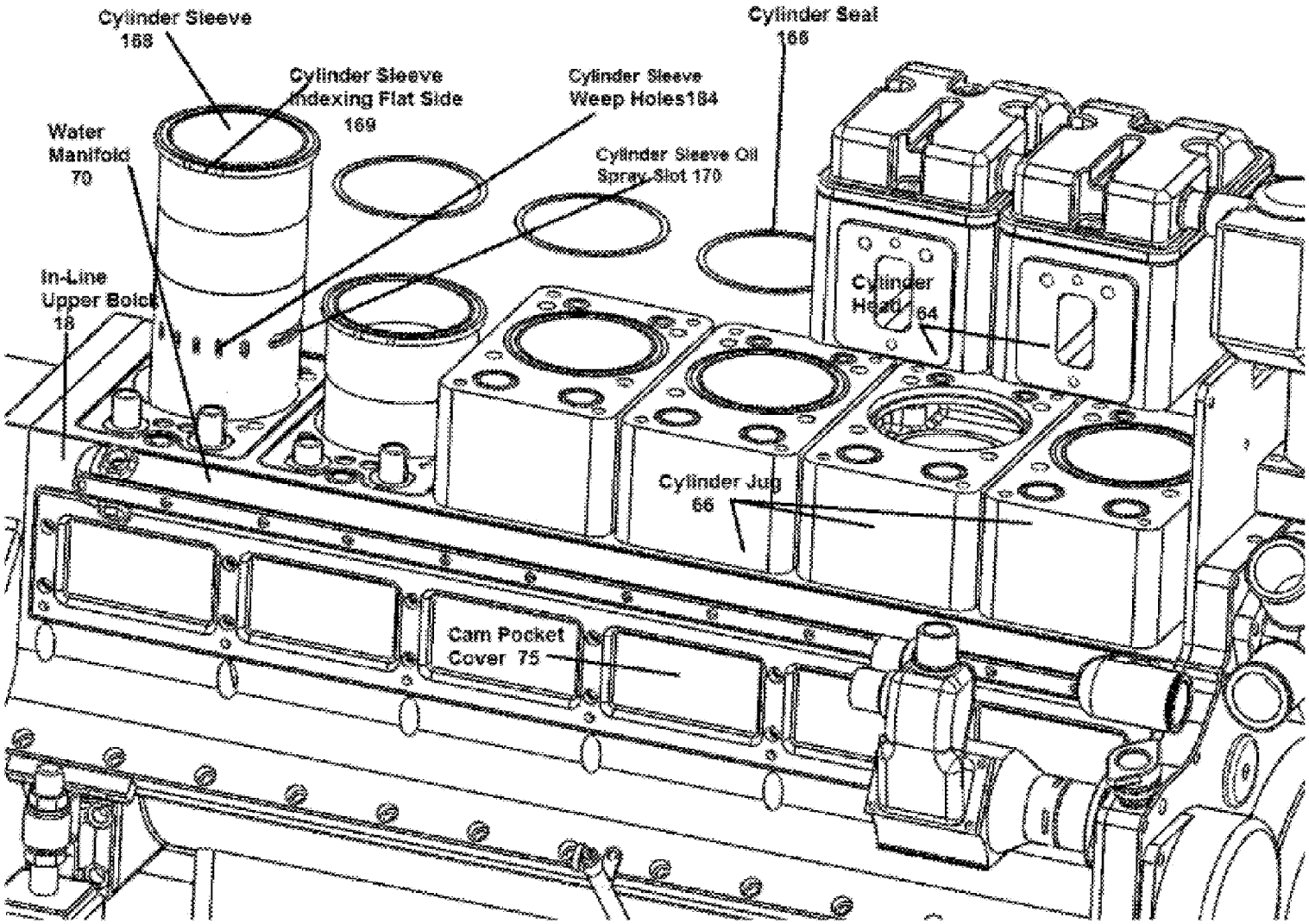
FIG. 18: is a drawing that shows the cylinder sleeve in relation to the upper block and the cylinder jugs.
Figure 19:
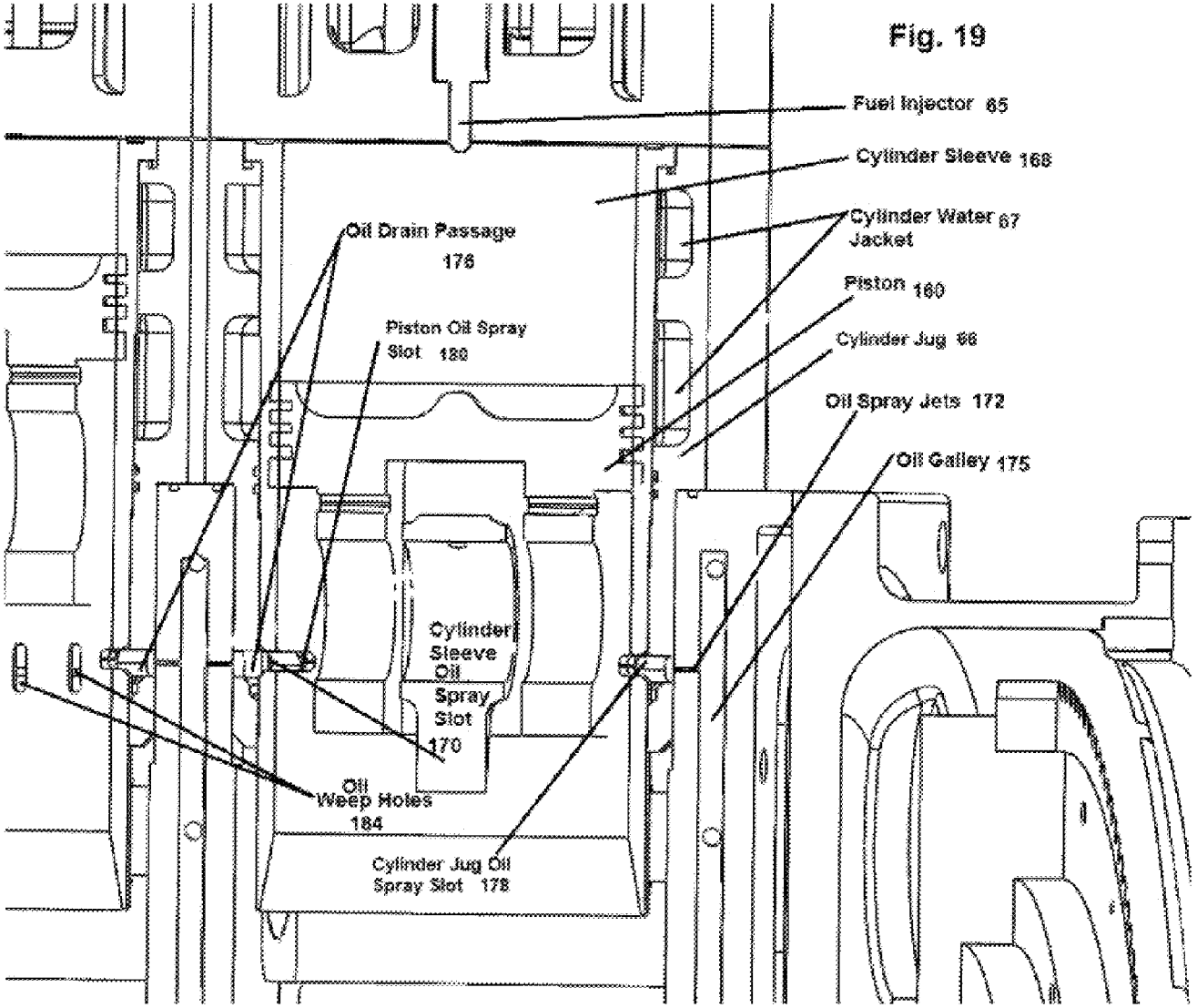
FIG. 19: is a cutaway drawing of the internal components of the invention that show the oil supply galley and related ports, jets and channels.
Figure 20:
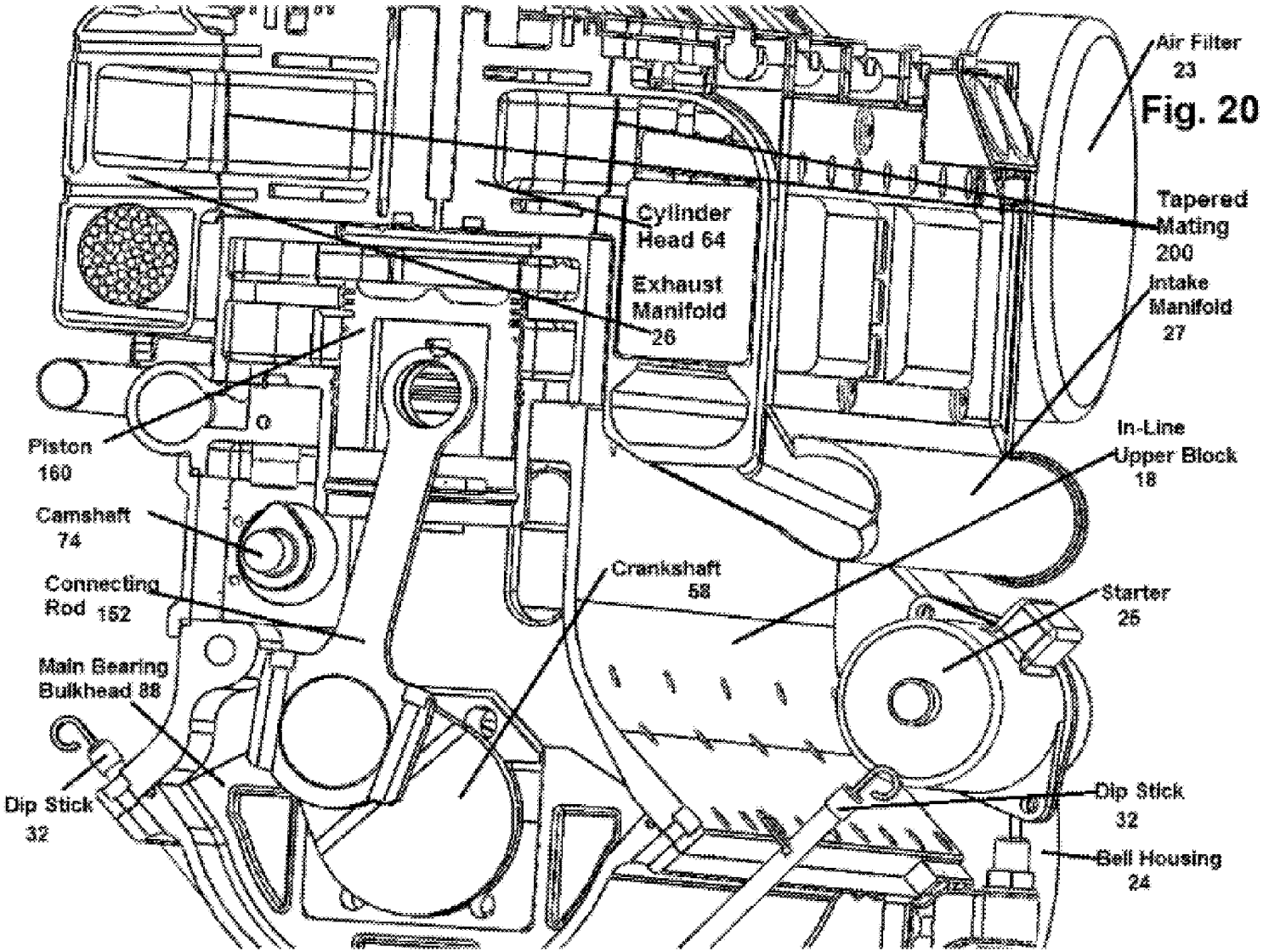
FIG. 20: is a cutaway drawing of the front right side view of the modular engine invention exposing the internal components and their relationship to each other.
Figure 21:
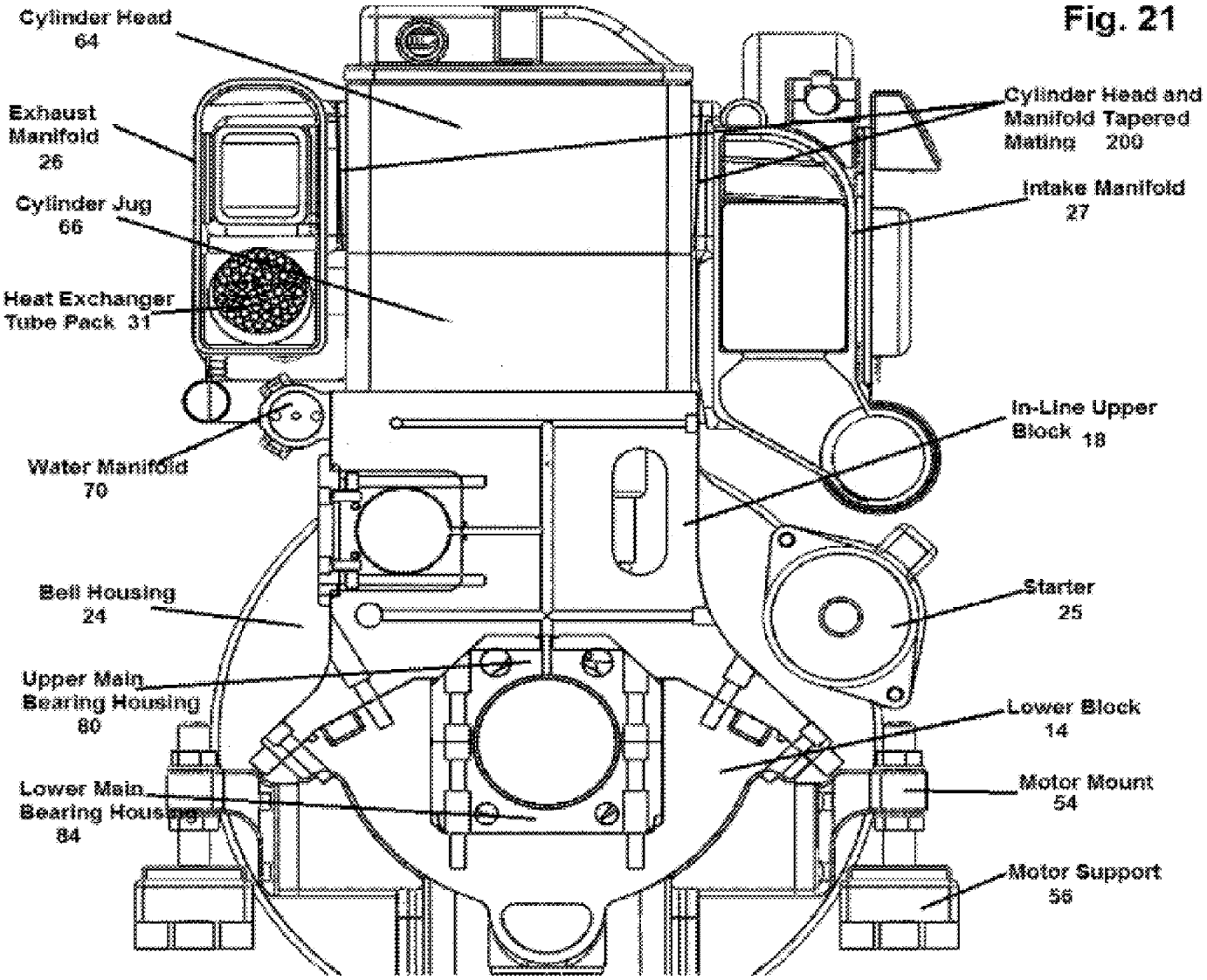
FIG. 21: is a cutaway view of the internal components of the modular engine invention that depicts the tapered mating of the cylinder head with the intake and exhaust manifolds.
Figure 22:
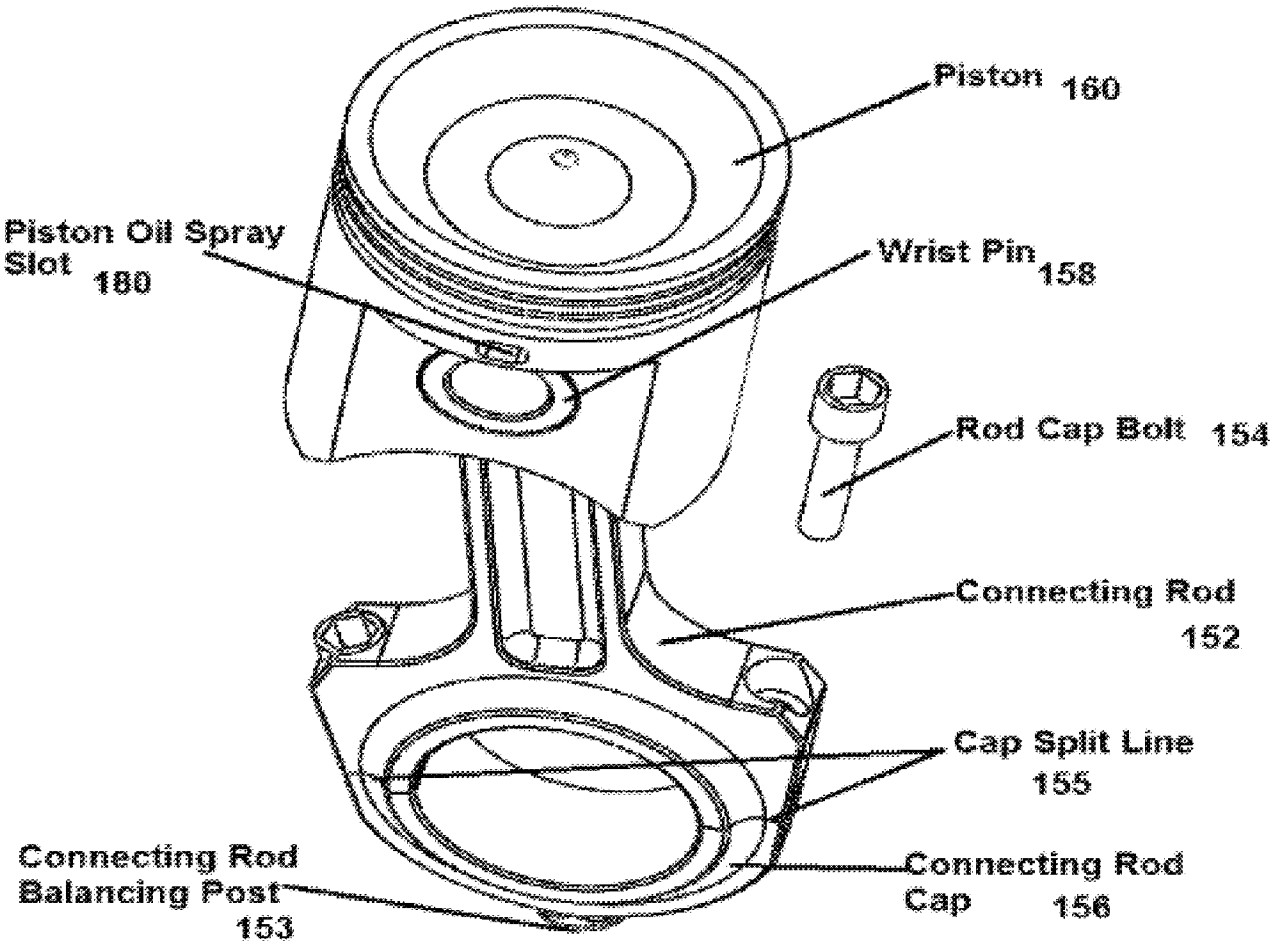
FIG. 22: is a drawing of the connecting rod, piston and wristpin as it applies to the invention.
Figure 23:
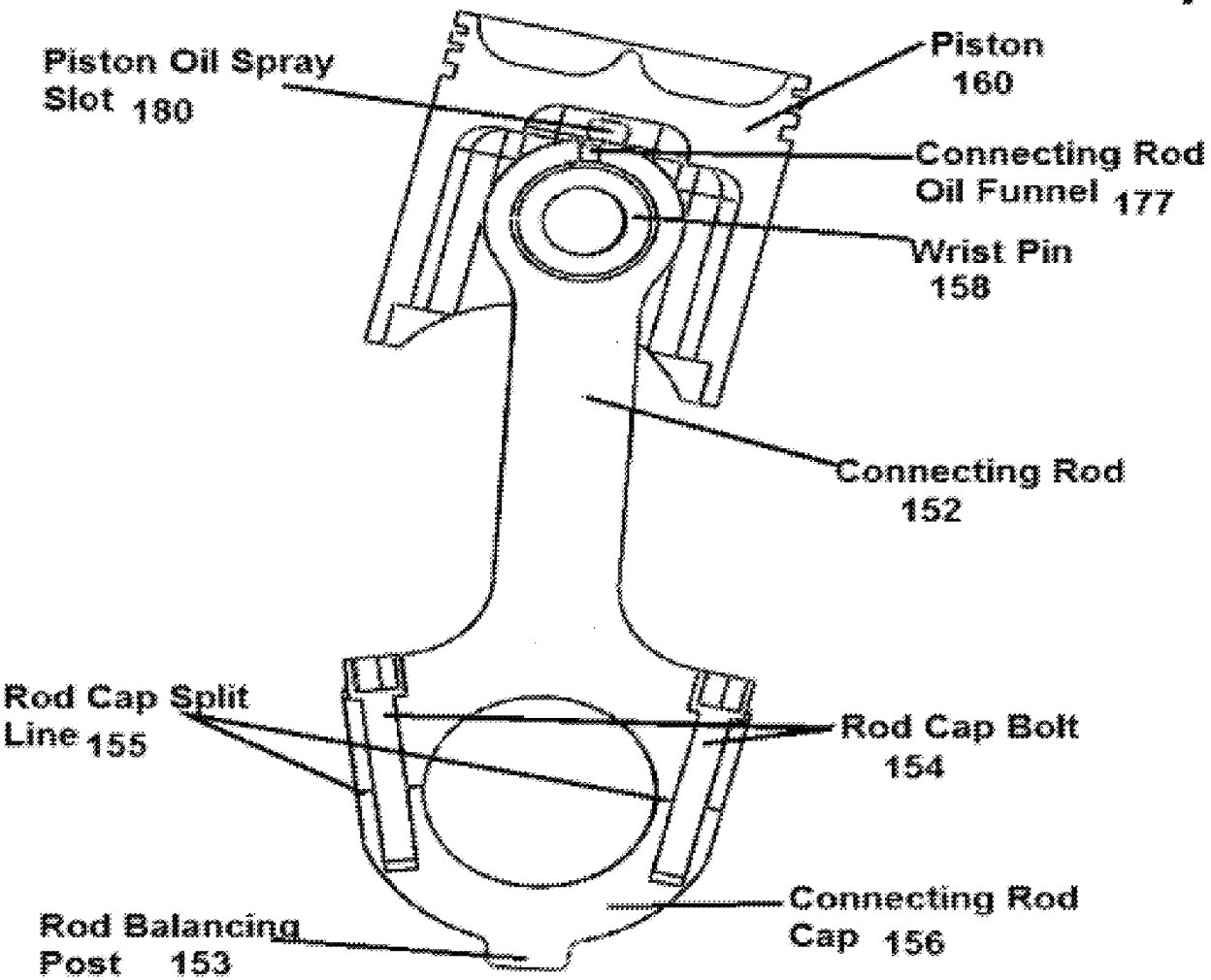
FIG. 23: is a cutaway view of the piston, connecting rod and wristpin depicting the splayed rod bolt application.

FIG. 17 is a drawing of an in-line upper block #18 positioned above the same (6 cylinder) lower block #14. The same mating surfaces are plainly visible with Indexing surface A #112, indexing surface B #114 and indexing surface C #124. The water manifold #70 and the motor mount #54 is also visible. FIG. 18 is a drawing that shows the special cylinder sleeve(s) #168 as they are installed in the engine invention. The sleeves create the cylinder bore in which the piston travels. The sleeves are inserted into the cylinder jugs #66 and are indexed with the indexing flat edge #169. The indexing flat edge #169 positions the sleeve so that the cylinder sleeve weep holes #184 and sleeve oil spray slot #170 are in the proper placement so that the oil spray from the oil spray jets is not blocked. The indexing flat edge #169 also prevents rotation of the sleeve during operation. The cylinder sleeve #168 plays an important role in the lubrication of the reciprocating assembly. Oil is sprayed through cylinder sleeve oil spray slot(s) #170 contained in the front and rear portions of cylinder sleeve #168. Oil spraying through cylinder sleeve oil spray slots #170 flows through piston oil slots #180 (see FIG. 9) and into the connecting rod oil funnel #177 (see FIG. 9), providing direct lubrication for the wristpin #158 (see FIG. 22). As piston #160 and connecting rod #152 move up and down through the cylinder sleeve #168, oil also flows into the hollow center of wristpin #158 (see FIG. 22), cooling the wristpin and piston. Some of the oil flows onto the inner cylindrical surface of the cylinder sleeve #168, providing piston lubrication. Additional piston lubrication is provided by oil passing through cylinder sleeve weep holes #184 in cylinder sleeve #168. This oil flows onto the cylinder's inner wall and lubricates the piston skirt, or outer cylindrical surface, of piston #160. The in-line upper block #18 is pictured in this drawing but both 60 degree V and 90 degree V style upper blocks utilize the same cylinder jugs and cylinder sleeves. FIG. 19 is a cutaway view of internal components of the modular engine invention. This drawing shows the oil galley #175 that supplies oil to the oil spray jets #172. It also shows the drain passages #176 where the excess oil from the oil spray jets #172 drains down through these oil drain passages #176 located in the cylinder jug #66 and exit through the cylinder sleeve weep holes #184 located in the cylinder sleeve #168. The drawing shows where the redundant oil spray from the oil spray jets #172 passes through the cylinder jug #66 by way of the cylinder jug oil spray slot #178 to pass through the cylinder sleeve oil spray slot #170 and to additionally pass through the piston oil spray slot #180, to lubricate the wristpin and connecting rod. The oil from the cylinder sleeve weep holes #184 wets the inside of the cylinder sleeve #168 where the piston skirt makes contact with the sleeve. FIG. 19 illustrates an important engine cooling and lubrication feature contributing to the longevity and reliability of the present engine. It is well known that engines operated at higher loads, particularly heavy-duty engines using elevated levels of turbocharger boost, have had issues surrounding piston and wristpin cooling as well as wristpin lubrication. The provision of adequate lube oil flow to the top end of a connecting rod is not a simple task. Some engines use oil jets mounted near the crankshaft and directed upwardly toward the wristpin and piston crown. However, mistakes have been made, such as the use of resin nozzles lacking in durability. It would be desirable to make far more oil available to the wristpin, the connecting rod upper bearing, and the piston, and the present lubrication system accomplishes this result. The redundant oil spray jets also support better oiling and reduced failures. FIG. 20 is a cutaway drawing of the internal components of the modular engine invention. This view is from the front right side of the engine and depicts the mating of the in-line upper block #18 with the interchangeable lower block #14 along the surface of the main bearing bulkhead #88. The starter #25 as it is attached to the bell housing #24 is also visible. The tapered mating #200 of the intake manifold #27 and exhaust manifold #26 is also visible. This tapered mating allows for quick and easy removal of an individual cylinder. The rotating assembly of the engine, including the piston #160, connecting rod #152 and crankshaft #58 is also displayed. Other parts depicted are the camshaft #74, the dipstick #32 and the air filter #23. FIG. 21 is a cutaway view of the internal components of the invention as well as a view of the mating of the exhaust manifold #26 and intake manifold #27 with the mating taper #200 of the cylinder head #64. This tapered mating allows for fast easy removal of an individual cylinder head #64 as well as the cylinder Jug #66. With this tapered design, the only bolts that need to be removed are the ones that secure the cylinder that is being serviced or replaced. No other bolts need to be loosened or removed. In the marine application, a heat exchanger tube pack #31 would perform somewhat like a radiator in an automotive application. In this application this heat exchanger is contained inside the wet exhaust manifold. The supporting parts of the engine including the motor mount #54 and motor support #56 are also shown and they function to reduce vibration as well as provide support for the complete engine. These parts are connected to the lower block #14 by way of removable bolts. The upper main bearing housing #80 and the lower main bearing housing #84 are replaceable components and may be produced using materials that increase heat transfer thereby reducing bearing operating temperatures. Other parts included in this drawing are the bell housing #24, the water manifold #70, the starter #25 and the in-line upper block #18. FIG. 22 is a drawing that shows the piston #160 and the connecting rod #152 along with the wristpin #158 and the connecting rod cap #156. The cap split line #155 is also visible as well as the angle entry of the rod cap bolts #154. As the drawing shows, the connecting rod bolts are installed from the top of the connecting rod assembly and the bolts are machined at an angle, tilted outward, so that the removal and installation tool will not strike the piston. Other displayed parts include the piston oil spray slot #180 and the connecting rod balancing post #153. FIG. 23 is a cutaway view of the piston #160 attached to the connecting rod #152 with the wristpin #158. The rod cap split line #155 is plainly depicted with angled machining and not with a straight through split. The connecting rod cap bolts #154 are installed perpendicular to the rod cap split lines #155. The oil funnel #177 is also visible along with the piston oil spray slot #180. The connecting rod cap #156 is shown attached to the connecting rod #152 and the connecting rod balancing post #153 is shown cast onto the connecting rod cap #156.

Figure 24:
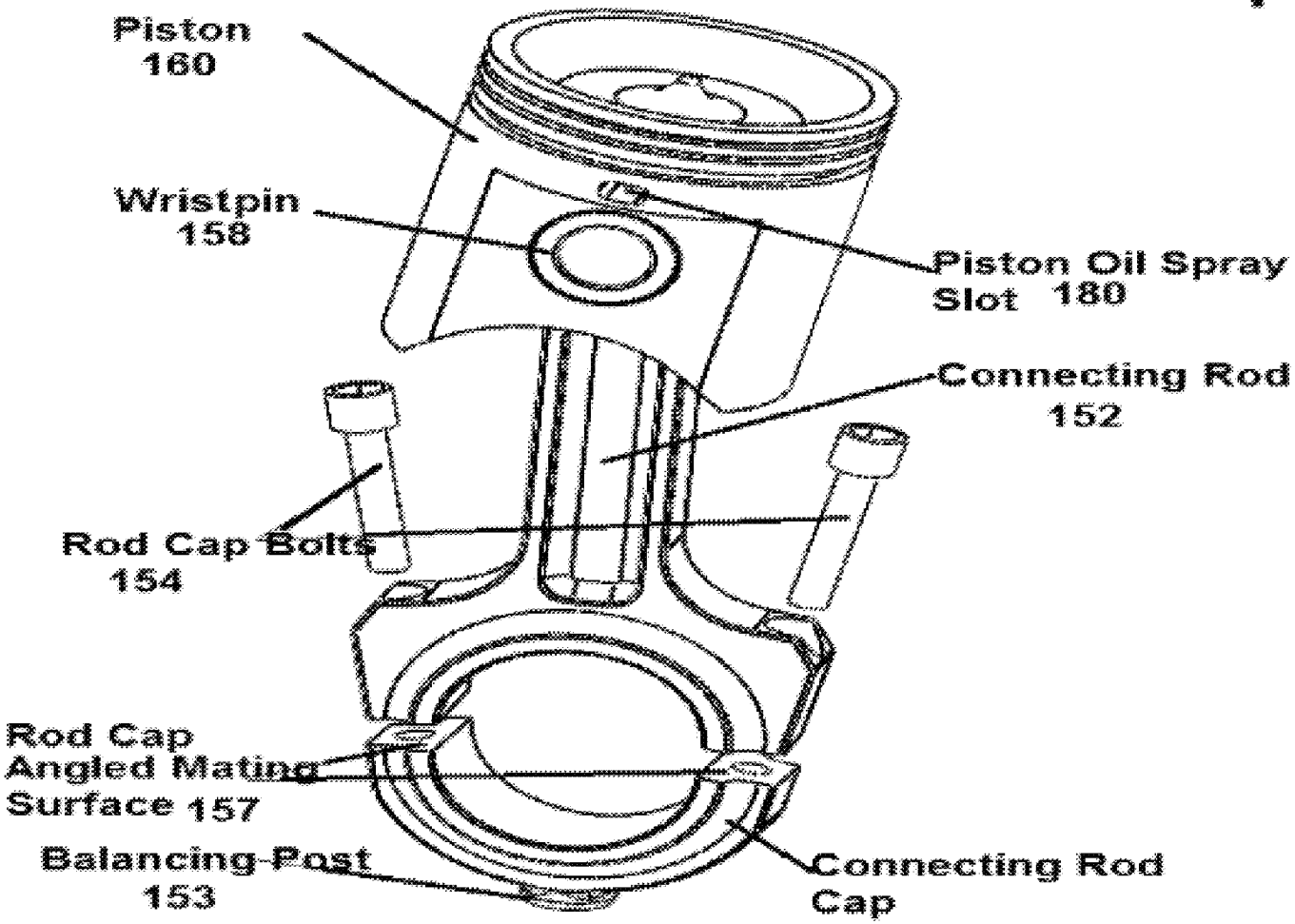
FIG. 24: Is an exploded view of the connecting rod, piston and connecting rod cap as it applies to the invention.

FIG. 24 is an exploded view of the piston, connecting rod and rod cap. This drawing plainly shows the connecting rod cap #156 angled mating surfaces #157 as they mate with the connecting rod #152. The splayed connecting rod cap bolt #154, installed from the top, is also visible. Rod cap bolt holes are machined perpendicular to the mating surfaces #157. The connecting rod balancing post #153 is also shown. The balancing post is provided as a place to remove material in order to balance the connecting rod set. The piston #160 and the piston oil spray slot #180 are also depicted.

Various embodiments may include one or more of the following:

An internal combustion engine of modular construction with an upper and lower block design where during repairs a plurality of upper blocks can be removed completely or tilted to the left or right;

An internal combustion engine of modular construction where the crankshaft is installed from the top of the engine rather than from the bottom;

An internal combustion engine of modular construction with a lower block that excepts a plurality of upper blocks, both in-line and V style;

a common upper block to support the cylinder jug(s) and cylinder head(s);

a modular engine with individual separate cylinder jug(s) mounted on a plurality of upper blocks;

a modular engine with individual separate cylinder head(s) mounted on and bolted through individual separate cylinder jug(s);

a modular engine with individual separate cylinder jug(s) each with its own separate coolant jacket and separate coolant intake from a common coolant rail delivery source, located on the upper block with a separate exit to its own separate cylinder head(s);

a modular engine with individual separate cylinder jug(s) each with its own separate coolant jacket and separate coolant intake from a common coolant rail delivery source, where the coolant flow through the cylinder jug(s) is perpendicular to the crankshaft;

a modular engine with individual separate cylinder head(s) each with its own separate coolant intake from its separate cylinder jug and separate exits to a wet exhaust manifold;

a modular engine with individual separate cylinder head(s) each with its own separate coolant intake from its separate cylinder jug where the coolant flow through the cylinder head is perpendicular to the coolant flow in the cylinder jug and perpendicular to the crankshaft;

a modular engine that when manufactured results in less waste due to casting and machining defects by the use of die casting;

an internal combustion engine with an upper and lower block with angular mating and indexing surfaces that allows for clearance for the rotating assembly whether used with an in-line or V style application;

an internal combustion engine with angular mating and indexing surfaces of the upper block to the lower block that allows easy installation and removal of the attaching bolts for both in-line and V style application rather than a vertical attachment where installation and removal of the bolts in a V style application would not be possible;

an internal combustion engine consisting of an in-line upper block that can be die cast;

an internal combustion engine consisting of a lower block that utilizes replaceable main bearing housings;

an internal combustion engine consisting of a lower block that utilizes indexing slots to hold the replaceable main bearing journal housings in place;

an internal combustion engine consisting of a lower block that does not require line boring during the manufacturing process;

an internal combustion engine consisting of a lower block that can be die cast in the manufacturing process;

an internal combustion engine consisting of a lower block that never needs to be removed from the application during repair.

What is claimed is:

1. An internal combustion engine comprising:

a lower block, wherein the lower block comprises:

a first mounting rail on a first side of the lower block; and a second mounting rail on a second side, wherein the second side is opposite to the first side;

an upper block, wherein the upper block is mounted on the lower block on the first mounting rail and the second mounting rail;

a cavity between the lower block and the upper block when the upper block is mounted on the lower block;

a crankshaft cradled in the lower block within the cavity;

a first hinge pin connected to a first end of the upper block near the first mounting rail with a first hinge pivot extending from the first hinge pin into a first bore; and a second hinge pin connected to a second end of the upper block near the first mounting rail with a second hinge pivot extending from the second hinge pin into a second bore; and wherein the upper block rotates about an axis defined by the first bore with the inserted first hinge pivot and the second bore with the inserted second hinge pivot to a tilt open position to expose the crankshaft cradled in the lower block.

2. The internal combustion engine of claim 1, wherein the upper block comprises supports, wherein a cylinder jug and a cylinder head are mounted on the supports, and wherein the internal combustion engine further comprises more than one cylinder jug and more than one cylinder head, wherein each cylinder jug is individually mounted, and wherein each cylinder head is individually mounted.

3. The internal combustion engine of claim 2, wherein each cylinder jug comprises a separate water jacket, wherein each water jacket comprises an intake entry from a common coolant source.

4. The internal combustion engine of claim 1, wherein the upper block comprises no water jacket.

5. The internal combustion engine of claim 1, wherein the upper block comprises three or more angled indexing surfaces, wherein each indexing surface mates to the lower block, and wherein each indexing surface is offset at an angle from the other indexing surfaces.

6. The internal combustion engine of claim 1 further comprising:

a third hinge pin connected to a first end of the upper block near the second mounting rail with a third hinge pivot extending from the third hinge pin; and a fourth hinge pin connected to a second end of the upper block near the second mounting rail with a fourth hinge pivot extending from the fourth hinge pin.

7. The internal combustion engine of claim 6 wherein a front plate has a first-hinge pin bore for receipt of the first hinge pivot and a third-hinge pin bore for receipt of the third hinge pivot.

8. The internal combustion engine of claim 6 wherein a bell housing has a second-hinge pin bore for receipt of the second hinge pivot and a fourth hinge pin bore for receipt of the fourth hinge pivot.

9. The internal combustion engine of claim 6 wherein the first mounting rail is sloped with a higher end of the first mounting rail located towards the cavity and a lower end of the first mounting rail located further from the cavity so that the first mounting rail slopes downward moving away from the cavity.

10. The internal combustion engine of claim 9 wherein the second mounting rail is sloped with a higher end of the second mounting rail located on towards the cavity and a lower end of the second mounting rail located further from the cavity so that the second mounting rail slopes downward moving away from the cavity.

11. The internal combustion engine of claim 1 further comprising:

a third hinge pin connected to a first end of the upper block near the second mounting rail with a third hinge pivot extending from the third hinge pin, the third hinge pivot engaged with an upper bore so that the upper block is retained in the tilt open position.

12. The internal combustion engine of claim 1 wherein the first hinge pin has at least one fastener to reversibly connect the first hinge pin to at least one bore in the upper block.

13. The internal combustion engine of claim 12 wherein the first hinge pin has at least one hinge pin mounting slot so that at least one fastener may be accessed, loosened, and then tightened after moving the first hinge pin relative to the at least one bore in the upper block to lock the first hinge pin in an engaged position with the first hinge pivot inserted into the first bore.

14. A method of accessing a crankshaft within an internal combustion engine, the method comprising:

removing fasteners connecting an upper block to a lower block at a first mounting rail on a first side of the internal combustion engine;

removing fasteners connecting the upper block to the lower block at a second mounting rail on a second side of the internal combustion engine, opposite from the first side;

inserting a first hinge pivot of a first hinge pin into a first bore on a front side of the internal combustion engine;

tightening a set of at least one fastener to bind the first hinge pin to the upper block on the first side of the internal combustion engine to maintain the first hinge pivot in an inserted position;

inserting a second hinge pivot of a second hinge pin into a second bore on a rear side opposite from the front side of the internal combustion engine;

tightening a set of at least one fastener to bind the second hinge pin to the upper block on the first side of the internal combustion engine to maintain the second hinge pivot in an inserted position; and rotating the upper block upward around an axis of rotation running through the first bore and the second bore to expose a cavity between the upper block and the lower block to provide access to the crankshaft.

15. The method of claim 14 wherein the step of inserting the first hinge pivot of the first hinge pin into the first bore on the front side of the internal combustion engine is preceded by:

loosening the set of at least one fastener binding the first hinge pin to the upper block and sliding the first hinge pin relative to the set of at least one fastener while the set of at least one fastener remains engaged with the upper block.

16. The method of claim 14 wherein the step of rotating the upper block upward around the axis of rotation running through the first bore and the second bore to expose a cavity between the upper block and the lower block is preceded by:

ensuring that a third hinge pivot of a third hinge pin is not engaged with a third bore on the second side of the internal combustion engine; and ensuring that a fourth hinge pivot of a fourth hinge pin is not engaged with a fourth bore on the second side of the internal combustion engine.

17. The method of claim 14 wherein the step of rotating the upper block upward around the axis of rotation running through the first bore and the second bore to expose a cavity between the upper block and the lower block is includes:

inserting a third hinge pivot of a third hinge pin into a upper bore on the front side of the internal combustion engine; and tightening a set of at least one fastener to bind the third hinge pin to the upper block on the second side of the internal combustion engine to maintain the third hinge pivot in an inserted position in the upper bore to hold the upper block as rotated upward.

18. The method of claim 14 further comprising removing a crankshaft from the cavity between the upper block and the lower block while the upper block is rotated upward around the axis of rotation running through the first bore and the second bore.

* * * * *